US011187030B2

(12) United States Patent
Wong

(10) Patent No.: US 11,187,030 B2
(45) Date of Patent: Nov. 30, 2021

(54) ROLLER SHUTTER FOR MITIGATING IMPACT FORCE

(71) Applicant: Gliderol Doors (S) Pte Ltd, Singapore (SG)

(72) Inventor: Lok Yung Wong, Singapore (SG)

(73) Assignee: Gliderol Doors (S) Pte Ltd, Singapore (SG)

( * ) Notice: Subject to any disclaimer, the term of this patent is extended or adjusted under 35 U.S.C. 154(b) by 0 days.

(21) Appl. No.: 16/760,311

(22) PCT Filed: Jul. 25, 2019

(86) PCT No.: PCT/SG2019/050363
§ 371 (c)(1),
(2) Date: Apr. 29, 2020

(87) PCT Pub. No.: WO2020/246941
PCT Pub. Date: Dec. 10, 2020

(65) Prior Publication Data

US 2021/0047881 A1 Feb. 18, 2021

(30) Foreign Application Priority Data

Jun. 6, 2019 (SG) ..... 10201905150P

(51) Int. Cl.
*E06B 9/15* (2006.01)
*E06B 9/17* (2006.01)
*E06B 9/58* (2006.01)

(52) U.S. Cl.
CPC ..... *E06B 9/15* (2013.01); *E06B 9/17046* (2013.01); *E06B 9/581* (2013.01);
(Continued)

(58) Field of Classification Search
CPC . E06B 3/488; E06B 9/15; E06B 9/581; E06B 9/17046; E06B 5/12;
(Continued)

(56) References Cited

U.S. PATENT DOCUMENTS 366,837 A * 7/1887 Howson ..... E06B 9/15 160/133
405,450 A * 6/1889 Wilson ..... E06B 9/15 160/133

(Continued)

FOREIGN PATENT DOCUMENTS

CA 3035140 3/2018
CN 207944872 10/2018

(Continued)

OTHER PUBLICATIONS

Strohs, DE 2823078; Machine translation retrieved from https://worldwide.espacenet.com/publicationDetails/biblio?CC=DE&NR=2823078A1&KC=A1&FT=D&ND=3&date=19791129&DB=&locale=en_EP (Year: 1979).*

(Continued)

*Primary Examiner* — Jerry E Redman
*Assistant Examiner* — Abe Massad
(74) *Attorney, Agent, or Firm* — Hovey Williams LLP

(57) ABSTRACT

A roller shutter may include a rotatable drum; a shutter curtain including a series of three or more elongate slats pivotally interlocked in a longitudinal-edge-to-longitudinal-edge arrangement and arranged parallel to the rotatable drum, wherein a first and second longitudinal end portions of each elongate slat may be respectively aligned to form a first side border and a second side border, respectively, of the shutter curtain, wherein the first and second longitudinal end portions of each elongate slat may be respectively provided with at least one eyelet-structure which protrudes therefrom,
(Continued)

whereby a first and second rows of eyelet-structures are formed along the first and second side borders; and at least a first cord and a second cord respectively strung loosely through all eyelet-structures of respective row of eyelet-structures, and each cord may be configured to confine all eyelet-structures of the respective row of eyelet-structures within a length of each cord.

18 Claims, 20 Drawing Sheets

(52) U.S. Cl.
CPC ..... *E06B 2009/1555* (2013.01); *E06B 2009/1566* (2013.01); *E06B 2009/1577* (2013.01); *E06B 2009/1583* (2013.01); *E06B 2009/1594* (2013.01)

(58) Field of Classification Search
CPC ..... E06B 2009/1594; E06B 2009/1583; E06B 2009/1566; E06B 2009/1577; E06B 2009/1555; E06B 2009/1516; E06B 2009/1572
See application file for complete search history.

(56) References Cited

U.S. PATENT DOCUMENTS 983,342 A * 2/1911 Bauer ..... E06B 9/15 160/133
2,152,117 A * 3/1939 Wade ..... E06B 9/388 160/177 R
3,954,379 A * 5/1976 Klocke ..... B29C 70/08 425/505
5,365,993 A * 11/1994 Jella ..... E05D 1/04 160/201
5,377,738 A * 1/1995 Cooper ..... E06B 9/15 160/133
6,279,276 B1 * 8/2001 Knoll ..... B65G 69/2876 160/205
6,371,189 B1 * 4/2002 Azoulai ..... E06B 9/165 160/113
6,631,749 B1 10/2003 Zabala
8,453,705 B2 * 6/2013 Miller ..... E05D 15/24 160/113
9,637,973 B1 5/2017 Berman et al.
2005/0082020 A1 4/2005 Miller
2011/0265959 A1 11/2011 Frede
2017/0356239 A1 * 12/2017 Ouyang ..... E06B 9/17076
2017/0356240 A1 * 12/2017 Balbach ..... E06B 9/58

FOREIGN PATENT DOCUMENTS

| | | |
|---|---|---|
| CN | 208267721 | 12/2018 |
| DE | 2823078 | 11/1979 |
| DE | 29620659 | 1/1997 |
| DE | 10222724 | 2/2003 |
| GB | 1239943 | 7/1971 |
| GB | 2410523 | 8/2005 |
| JP | 2017-227039 | 12/2017 |
| JP | 2018-9356 | 1/2018 |
| KR | 10-2004-0027576 | 4/2004 |
| KR | 10-2008-0003740 | 1/2008 |
| TW | M500142 | 5/2015 |
| WO | 2016/081576 | 5/2016 |

OTHER PUBLICATIONS

Machine Translation in English of DE2823078, 5 pages.
Machine Translation in English of DE 10222724, 16 pages.
Machine Translation in English of DE29620659, 15 pages.
Machine Translation in English of CN207944872, 15 pages.
International Search Report dated Oct. 8, 2019 in corresponding PCT/SG2019/050363 filed Jul. 25, 2019, 4 pages.
Written Opinion dated Oct. 8, 2019 in corresponding PCT/SG2019/050363 filed Jul. 25, 2019, 5 pages.
International Preliminary Report on Patentability dated Oct. 10, 2020 in corresponding PCT/SG2019/050363 filed Jul. 25, 2019, 4 pages.
Examination Report dated Mar. 28, 2020 in corresponding Australian Patent Application No. 2019341063, 3 pages.
Machine Translation in English of JP20189356, 22 pages.
Office Action dated Jun. 17, 2020 in corresponding Taiwanese Patent Application No. 108126418, 12 pages.
English translation of Jun. 17, 2020 Office Action in corresponding Taiwanese Patent Application No. 108126418, 9 pages.
Machine Translation of JP2017227039, 21 pages.
Machine Translation of CN208267721, 8 pages.
Extended European Search Report dated May 19, 2021 in corresponding European Patent Application No. 19856411.4, 7 pages.
Korean Office Action (with English summary) dated Jun. 15, 2021 in corresponding Korean Patent Application No. 10-2020-7033944. 5 pages.
Machine Translation of KR20040027576, 10 pages.
Machine Translation of KR20080003740, 8 pages.

* cited by examiner

ROLLER SHUTTER FOR MITIGATING IMPACT FORCE

RELATED APPLICATIONS

This application claims priority to PCT International Patent Application No. PCT/SG2019/050363 filed Jul. 25, 2019, which claims the priority benefit of Singaporean Patent Application No. 10201905150P filed Jun. 6, 2019, both of which are hereby incorporated by reference in their entireties.

TECHNICAL FIELD

Various embodiments generally relate to a roller shutter for mitigating an impact force.

BACKGROUND

Roller shutter has been commonly installed at the entrance of various types of premises such as retail shops, warehouses, buildings, hangars, garages, etc. for controlling physical access into the enclosed space of the respective premises. When the shutter curtain of the roller shutter is down, it provides some form of protection against environmental factors such as wind and/or rain. It also provides certain amount of security protection against intrusion or breaking in. A typical roller shutter generally includes a plurality of horizontally extending slats connected to each other to form the shutter curtain. The shutter curtain is being wound on and/or off a drum to raise or lower the shutter curtain. Further, the shutter curtain is typically guided by guide channels along the two sides of the entrance. Such conventional roller shutter may suffice for the purpose of simple protection against wind and/or rain, or limited protection against intrusion or breaking in. However, strong wind during storm or typhoon, or an explosion or a blast which may apply a sudden impact force on the roller shutter may cause the individual slats of the shutter curtain to break into pieces and dislodge from the shutter curtain to become flying shrapnel that may cause further property damage or personnel injury.

Accordingly, there is a need for an effective roller shutter to address the above issues, for example to mitigate the sudden impact force on the roller shutter.

SUMMARY

According to various embodiments, there is provided a roller shutter. The roller shutter may include a rotatable drum having a rotational axis. The roller shutter may include a shutter curtain including a series of three or more elongate slats pivotally interlocked in a longitudinal-edge-to-longitudinal-edge arrangement one after another and arranged parallel to the rotational axis of the rotatable drum in a manner so as to be capable of being wound on and off the rotatable drum together in an interlocked state. According to various embodiments, each of the elongate slats may have a first longitudinal end portion and a second longitudinal end portion, wherein the first and second longitudinal end portions may be respectively aligned to form a first side border and a second side border, respectively, of the shutter curtain. According to various embodiments, the first longitudinal end portion and the second longitudinal end portion of each elongate slat may be respectively provided with at least one eyelet-structure which protrudes therefrom, whereby a first row of eyelet-structures and a second row of eyelet-structures are formed along the first and second side borders, respectively, of the shutter curtain. The roller shutter may further include at least a first cord and a second cord. According to various embodiments, the first cord may be strung loosely through all eyelet-structures of the first row of eyelet-structures and the second cord may be strung loosely through all eyelet-structures of the second row of eyelet-structures. According to various embodiments, each cord may be configured to confine all eyelet-structures of respective row of eyelet-structures within a length of each cord.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments are described with reference to the following drawings, in which.

DETAILED DESCRIPTION

Embodiments described below in the context of the apparatus are analogously valid for the respective methods, and vice versa. Furthermore, it will be understood that the embodiments described below may be combined, for example, a part of one embodiment may be combined with a part of another embodiment.

It should be understood that the terms "on", "over", "top", "bottom", "down", "side", "back", "left", "right", "front", "lateral", "side", "up", "down" etc., when used in the following description are used for convenience and to aid understanding of relative positions or directions, and not intended to limit the orientation of any device, or structure or any part of any device or structure. In addition, the singular terms "a", "an", and "the" include plural references unless context clearly indicates otherwise. Similarly, the word "or" is intended to include "and" unless the context clearly indicates otherwise.

Various embodiments generally relate to a roller shutter. In particular, various embodiments generally relate to a roller shutter for resisting strong wind forces and/or for mitigating a sudden impact force of an explosion or a blast. In resisting strong wind forces and/or mitigating the sudden impact force, the roller shutter according to various embodiments may minimize breakage or fracture. Further, the roller shutter according to various embodiments may be configured such that the risk of broken or fractured slats being dislodged from the shutter curtain be minimized or eliminated. According to various embodiments, the roller shutter may be configured to prevent the slats of the shutter curtain from breaking into pieces and/or dislodging to become flying shrapnel.

Figure 1:
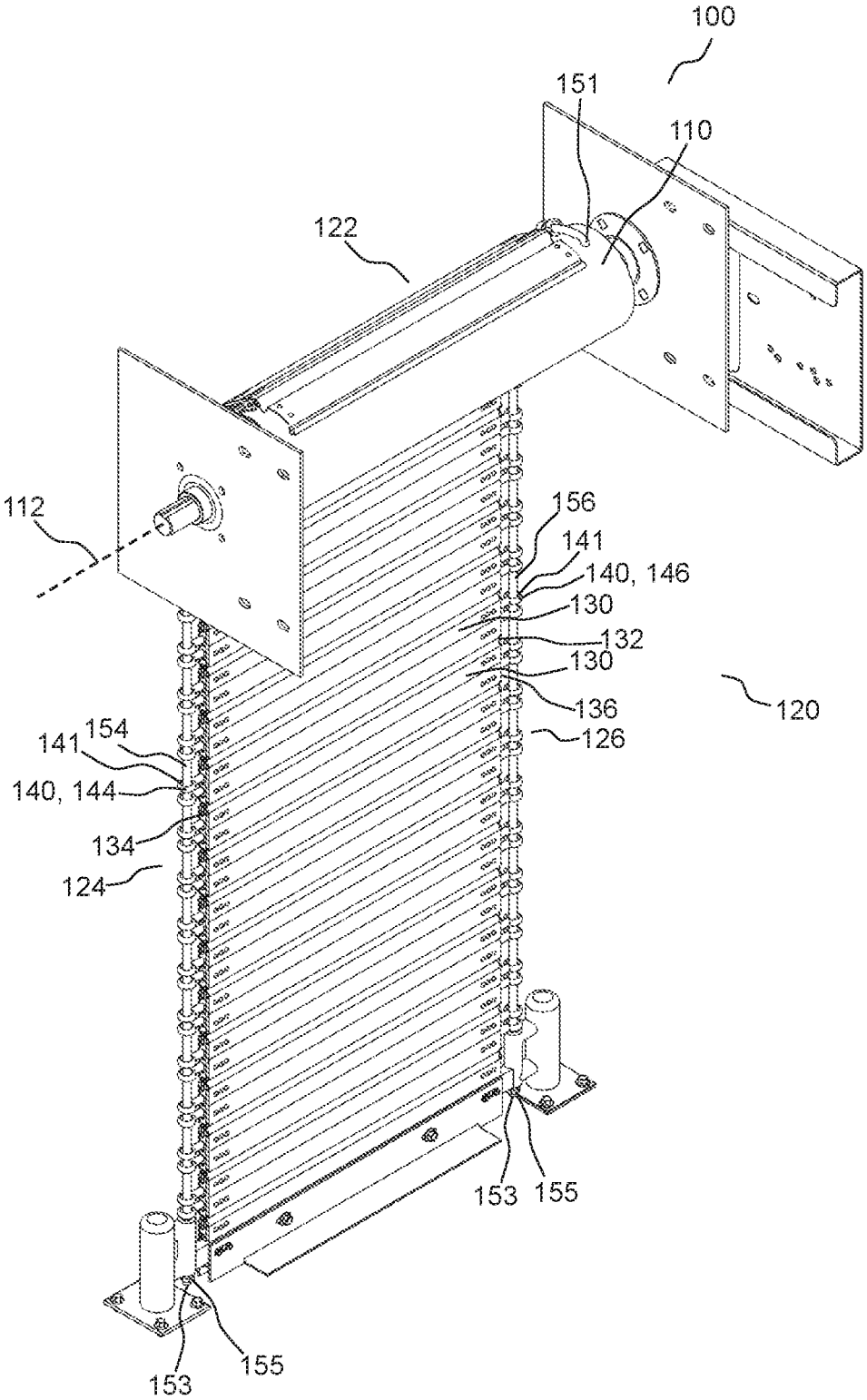
FIG. 1 shows a shows a roller shutter according to various embodiments.

FIG. 1 shows a roller shutter 100 according to various embodiments. According to various embodiments, the roller shutter 100 may be configured for mitigating an impact force applied to the roller shutter 100. According to various embodiments, the roller shutter 100 may include a rotatable drum 110 having a rotational axis 112. According to various embodiments, the rotatable drum 110 may be of a cylindrical shape wherein an axis of the cylindrical shape may be the rotational axis 112 of the rotatable drum 110. According to various embodiments, the roller shutter 100 may include a shutter curtain 120. According to various embodiments, the shutter curtain 120 may be configured to be wound on and off the rotatable drum 110 in a manner so as to be raised or lowered for opening or closing an entrance. According to various embodiments, a lead portion 122 of the shutter curtain 120 may be coupled to the rotatable drum 110 such that rotating the drum 110 in a first rotational direction may wind the shutter curtain 120 onto the rotatable drum 110 so as to raise the shutter curtain 120, and rotating the drum 110 in a second rotational direction, which is opposite the first rotational direction, may unwind the shutter curtain 120 from the rotatable drum 110 so as to lower the shutter curtain 120.

According to various embodiments, the shutter curtain 120 may include a series of three or more elongate slats 130. Accordingly, the three or more elongate slats 130 may be arranged in sequence to form a set of three or more successive elongate slats 130. According to various embodiments, the series of three or more elongate slats 130 may be pivotally interlocked in a longitudinal-edge-to-longitudinal-edge arrangement one after another. Accordingly, the three or more elongate slats 130 may be connected or engaged in a manner in which two immediately adjacent elongate slats 130 may be connected or engaged along respective longitudinal edges 132 between the two immediately adjacent elongate slats 130 so as to be locked or attached to each other along their respective longitudinal edges 132. According to various embodiments, the two immediately adjacent elongate slats 130 may be pivotable relative to each other about a pivoting axis along a connection or an engagement between the respective longitudinal edges 132 of the two immediately adjacent elongate slats 130, and may be so connected or engaged such that the two immediately adjacent elongate slats 130 may be non-separable in a direction perpendicular to the pivoting axis.

According to various embodiments, the series of three or more elongate slats 130 may be arranged parallel to the rotational axis 112 of the rotatable drum 110. Accordingly, the shutter curtain 120 may be oriented such that each of the three or more elongate slats 120 may be extending longitudinally in a direction parallel to the rotational axis 112 of the rotatable drum 110. Hence, the longitudinal edges 132 of each elongate slat 120 may be parallel to the rotational axis 112 of the rotatable drum 110. According to various embodiments, with the series of three or more elongate slats 130 being arranged parallel to the rotational axis 112 of the rotatable drum 110, the series of three or more elongate slats 130 of the shutter curtain 120 may be wound on and off the rotatable drum 110 together in an interlocked state. Accordingly, the series of three or more elongate slats 130, which may be articulated to one another as a whole, may be wound onto the rotatable drum 110 so as to raise the shutter curtain 120 and may be unwound from the rotatable drum 110 so as to lower the shutter curtain 120.

According to various embodiments, each of the elongate slats 130 may have a first longitudinal end portion 134 and a second longitudinal end portion 136. According to various embodiments, the first and second longitudinal end portions 134, 136 of each elongate slat 130 may be respective portions at respective extremity, lengthwise, of said elongate slat 130. According to various embodiments, the first and second longitudinal end portions 134, 136 may be respectively aligned to form a first side border 124 and a second side border 126, respectively, of the shutter curtain 120. According to various embodiments, all the first longitudinal end portions 134 of the series of three or more elongate slats 130 may be aligned or brought into alignment to form a continuous line so as to form the first side border 124 of the shutter curtain 120. According to various embodiments, all the second longitudinal end portions 136 of the series of three or more elongate slats 130 may be aligned or brought into alignment to form a continuous line so as to form the second side border 126 of the shutter curtain 120.

According to various embodiments, the first longitudinal end portion 134 and the second longitudinal end portion 136 of each elongate slat 130 of the series of three or more elongate slats 130 may be respectively provided with at least one eyelet-structure 140 which protrudes therefrom. According to various embodiments, each elongate slat 130 of the series of three or more elongate slats 130 may include at least one eyelet-structure 140 protruding or jutting out from the first longitudinal end portion 134 of said elongate slat 130. According to various embodiments, each elongate slat 130 of the series of three or more elongate slats 130 may include at least one eyelet-structure 140 protruding or jutting out from the second longitudinal end portion 136 of said elongate slat 130. Accordingly, every one of the three or more elongate slats 130 may include at least one eyelet-structure 140 protruding from respective first longitudinal end portion 134 thereof and at least one eyelet-structure 140 protruding from respective second longitudinal end portion 136 thereof.

According to various embodiments, a first row 144 of eyelet-structures 140 and a second row 146 of eyelet-structures 140 may be formed along the first and second side borders 124, 126, respectively, of the shutter curtain 120. According to various embodiments, all the eyelet-structures 140 of all the first longitudinal end portions 134 of the series of three or more elongate slats 130 may be arranged or placed in succession into a line so as to make up the first row 144 of eyelet-structures 140 running alongside the first side border 124 of the shutter curtain 120. According to various embodiments, holes of all the eyelet-structures 140 of all the first longitudinal end portions 134 of the series of three or more elongate slats 130 may be in line with each other. According to various embodiments, all the eyelet-structures 140 of all the second longitudinal end portions 136 of the series of three or more elongate slats 130 may be arranged or placed in succession into a line so as to make up the second row 146 of eyelet-structures 140 running alongside the second side border 126 of the shutter curtain 120. According to various embodiments, holes of all the eyelet-structures 140 of all the second longitudinal end portions 136 of the series of three or more elongate slats 130 may be in line with each other.

According to various embodiments, the roller shutter 100 may include a first cord 154 and a second cord 156. According to various embodiments, each of the first cord 154 and the second cord 156 may include, but not limited to, a steel wire, a steel cable, or a steel cord. According to various embodiments, the first cord 154 may be strung loosely through all the eyelet-structures 140 of the first row 144 of eyelet-structures 140. Accordingly, all the eyelet-structures 140 of the first row 144 of eyelet-structures 140 may be connected by the first cord 154 which is passed through or threaded through respective eyeholes 141 of all the eyelet-structures 140 of the first row 144 of eyelet-structures 140. According to various embodiments, the second cord 156 may be strung loosely through all the eyelet-structure 140 of the second row 146 of eyelet-structures 140. Accordingly, all the eyelet-structures 140 of the second row 146 of eyelet-structures 140 may be connected by the second cord 156 which is passed through or threaded through respective eyeholes 141 of all the eyelet-structures 140 of the second row 146 of eyelet-structures 140.

According to various embodiments, each cord 154, 156 may be configured to confine all eyelet-structures 140 of respective row 144, 146 of eyelet-structures 140 within a length of each cord 154, 156. According to various embodiments, the first cord 154 may be configured to keep or retain all the eyelet-structures 140 of the first row 144 of eyelet-structures 140 within bounds or limits as defined by the length of the first cord 154. Accordingly, all the eyelet-structures 140 of the first row 144 of eyelet-structures 140 may be placed or put upon the first cord 154 in a manner so as to be non-separable from the first cord 154 and be restrained from sliding out of the first cord 154. According to various embodiments, the second cord 156 may be configured to keep or retain all the eyelet-structures 140 of the second row 146 of eyelet-structures 140 within bounds or limits as defined by the length of the second cord 156. Accordingly, all the eyelet-structures 140 of the second row 146 of eyelet-structures 140 may be placed or put upon the second cord 156 in a manner so as to be non-separable from the second cord 156 and be restrained from sliding out of the second cord 156.

According to various embodiments, as shown in FIG. 1, each cord 154, 156 may include a first cord end 151 fixedly coupled to the rotatable drum 110 and a second cord end 153 having a stopper element 155 which is configured to prevent the second cord end 153 of said cord 154, 156 from sliding out of the respective row 144, 146 of eyelet-structures 140. According to various embodiments, with the first cord end 151 of each cord 154, 156 fixedly coupled to the rotatable drum 110, the rotatable drum 110 may serve as a physical barrier to restrain or restrict or obstruct the eyelet-structures 140 from sliding out from the first cord end 151. According to various embodiments, with the stopper element 155 at the second cord end 153 of each cord 154, 156, the stopper element 155 may serve as a physical barrier to restrain or restrict or obstruct the eyelet-structures 140 from sliding out from the second cord end 153. According to various embodiments, the stopper element 155 may include, but not limited to, a crimp end, a cord end cap, a knotted end, a bulged end, or an expanded end.

According to various embodiments, not shown, each cord may include a first cord end having a first stopper element which is configured to prevent the first cord end of said cord from sliding out of the respective row of eyelet-structures, and a second cord end having a second stopper element which is configured to prevent the second cord end of said cord from sliding out of the respective row of eyelet-structures. According to various embodiments, with the first stopper element and the second stopper element respectively disposed at the first cord end and the second cord end, respectively, of said cord, the first stopper element at the first cord end may serve as a physical barrier to restrain or restrict or obstruct the eyelet-structures from sliding out from the first cord end and the second stopper element at the second cord end may serve as a physical barrier to restrain or restrict or obstruct the eyelet-structures from sliding out from the second cord end. According to various embodiments, the first stopper element and the second stopper element each may include, but not limited to, a crimp end, a cord end cap, a knotted end, a bulged end, or an expanded end.

According to various embodiments, the first cord 154 and the second cord 156 may respectively cooperate with the first row 144 of eyelet-structures 140 and the second row 146 of eyelet-structures 140 in a manner so as to collectively provide additional securing points and/or holding points for the respective elongate slats such that the respective elongate slats 130 may be retained or held even if the respective elongate slats 130 are broken or fracture from an impact force. According to various embodiments, the first cord 154 and the second cord 156 together with the first row 144 of eyelet-structures 140 and the second row 146 of eyelet-structures 140 may be an assemblage of interacting and/or interdependent features forming a unified whole system for mitigating an impact force.

According to various embodiments, the at least one eyelet-structure 140 of each longitudinal end portion 134, 136 of each elongate slat 130 may be protruding in a longitudinal direction of said elongate slat 130. Accordingly, each elongate slat 130 of the series of three or more elongate slats may include at least one eyelet-structure 140 protruding from the first longitudinal end portion 134 thereof in a direction of a length of said elongate slat 130 and at least one eyelet-structure 140 protruding from the second longitudinal end portion 134 thereof in the direction of the length of said elongate slat 130. According to various embodiments, the at least one eyelet-structure 140 of each longitudinal end portion 134, 136 of each elongate slat 130 may be oriented with an axis of a hole of the at least one eyelet-structure 140 of each longitudinal end portion 134, 136 of each elongate slat 130 in a direction parallel to a breadth of said elongate slat 130. Accordingly, the axis of the hole of the at least one eyelet-structure 140 of each longitudinal end portion 134, 136 of each elongate slat 130 may be parallel to a perpendicular direction extending between two longitudinal edges of said elongate slat 130.

According to various embodiments, as shown in FIG. 1, each of the elongate slats 130 may include two eyelet-structures 140 protruding from each longitudinal end portion 134, 136 of said elongate slat 130. According to various embodiments, the first longitudinal end portion 134 of each elongate slat 130 may include two eyelet-structures 140 protruding therefrom, and the second longitudinal end portion 136 of each elongate slat 130 may include two eyelet-structures 140 protruding therefrom.

Figure 2A:
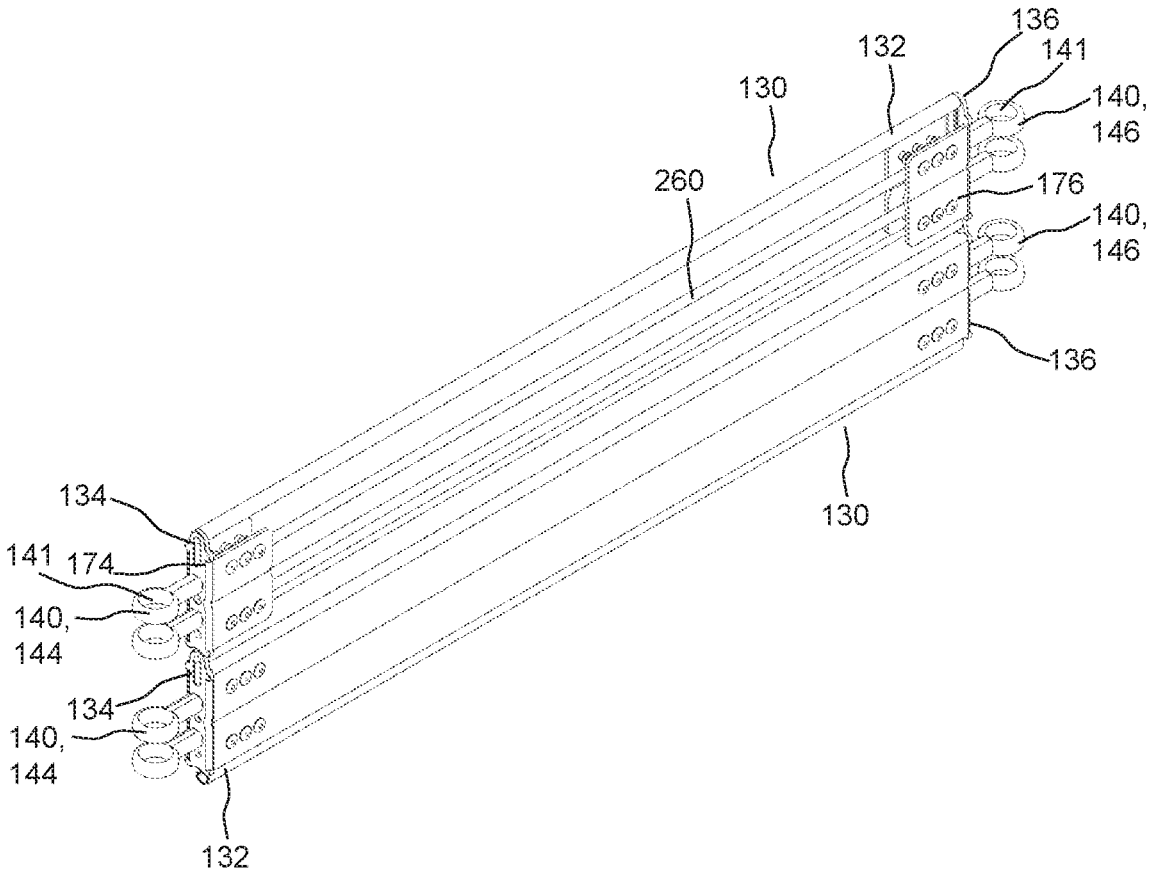
FIG. 2A shows two pivotally interlocked elongate slats of the shutter curtain of the roller shutter of FIG. 1 with a surface of one of the elongate slats cutaway to show an interior of said elongate slat according to various embodiments.
Figure 2B:
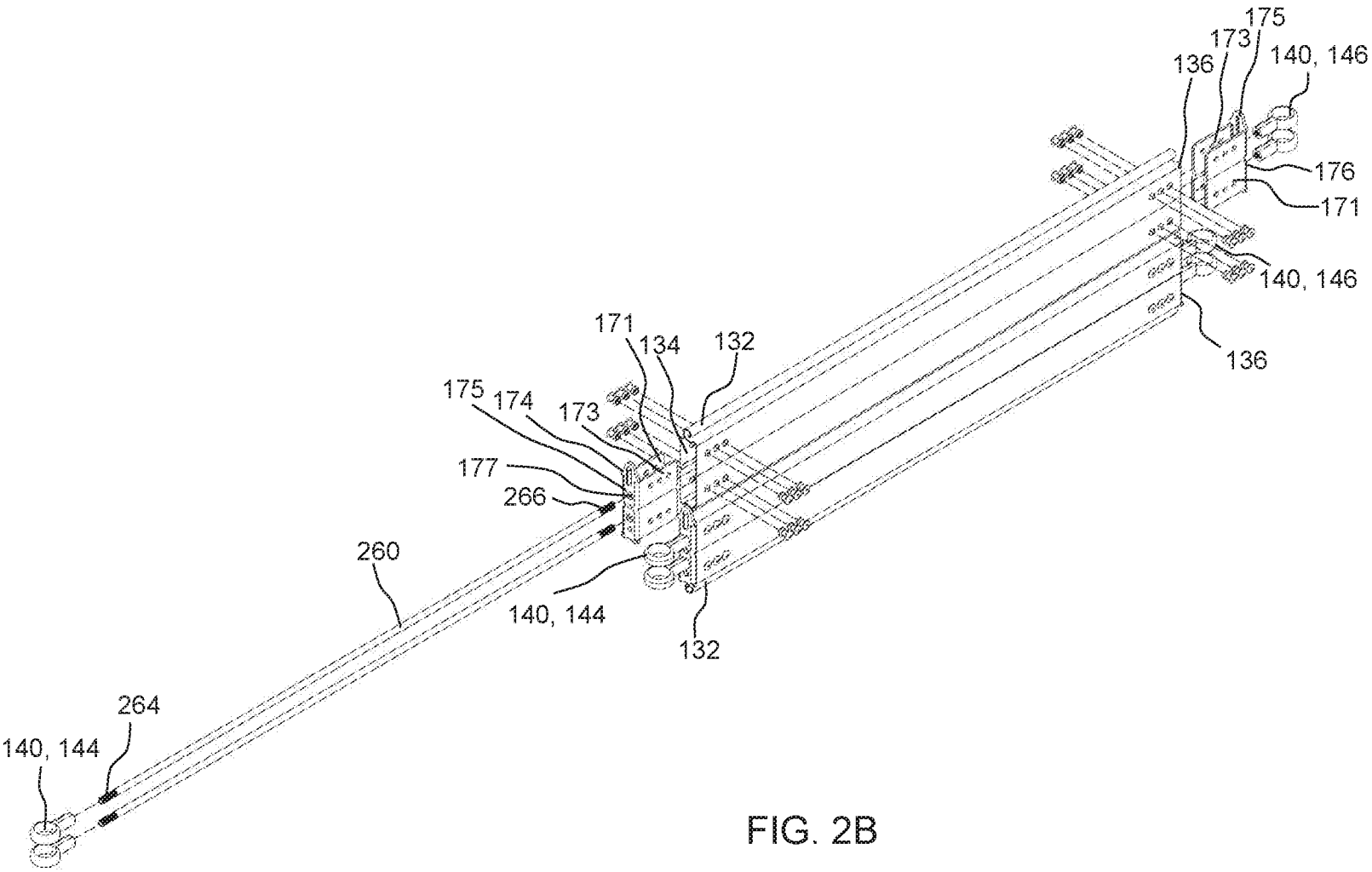
FIG. 2B shows the two pivotally interlocked elongate slats of FIG. 2A with one of the elongate slats in an exploded view according to various embodiments.

FIG. 2A shows two pivotally interlocked elongate slats 130 of the shutter curtain 120 of the roller shutter 100 of FIG. 1 with a surface of one of the elongate slats 130 cutaway to show an interior of said elongate slat 130 according to various embodiments. FIG. 2B shows the two pivotally interlocked elongate slats 130 of FIG. 2A with one of the elongate slats 130 in an exploded view according to various embodiments.

Figure 3A:
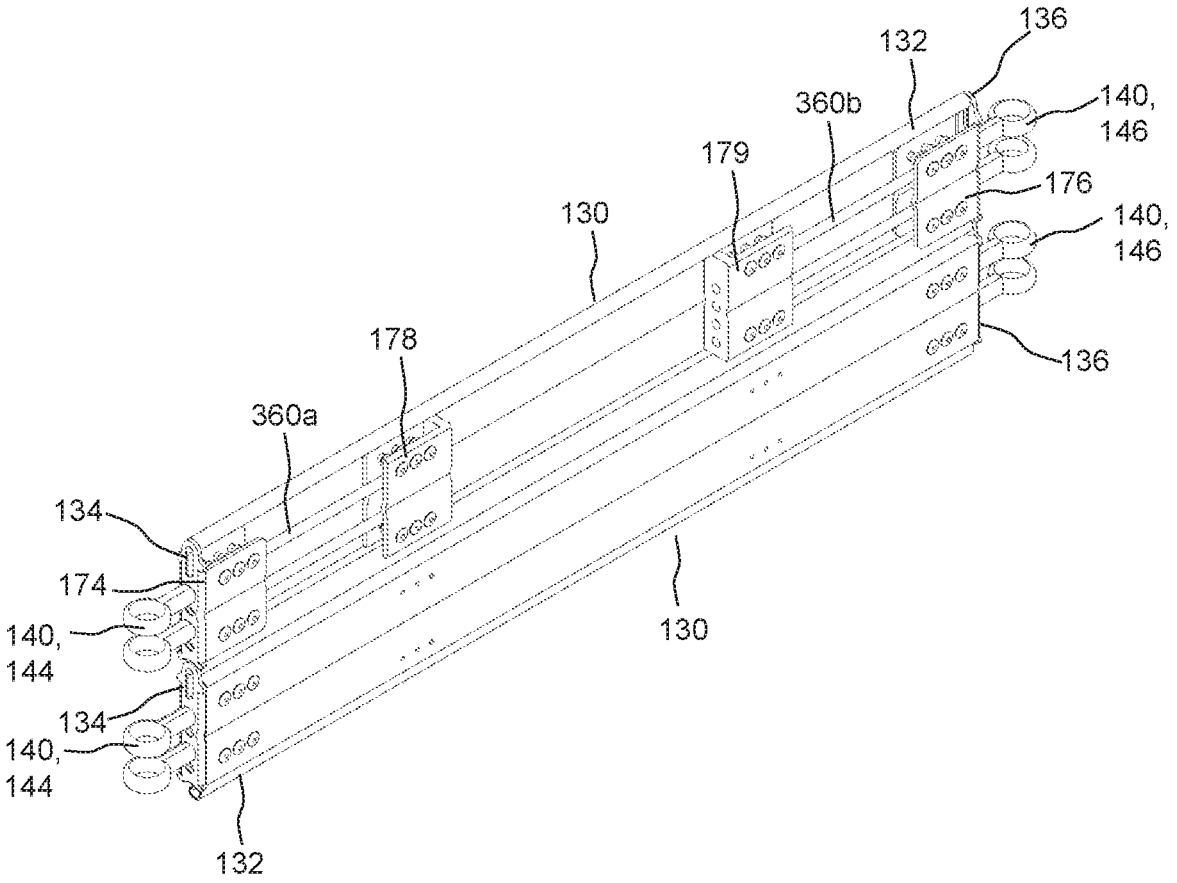
FIG. 3A shows two pivotally interlocked elongate slats of the shutter curtain of the roller shutter of FIG. 1 with a surface of one of the elongate slats cutaway to show a variant of an interior of said elongate slat according to various embodiments.
Figure 3B:
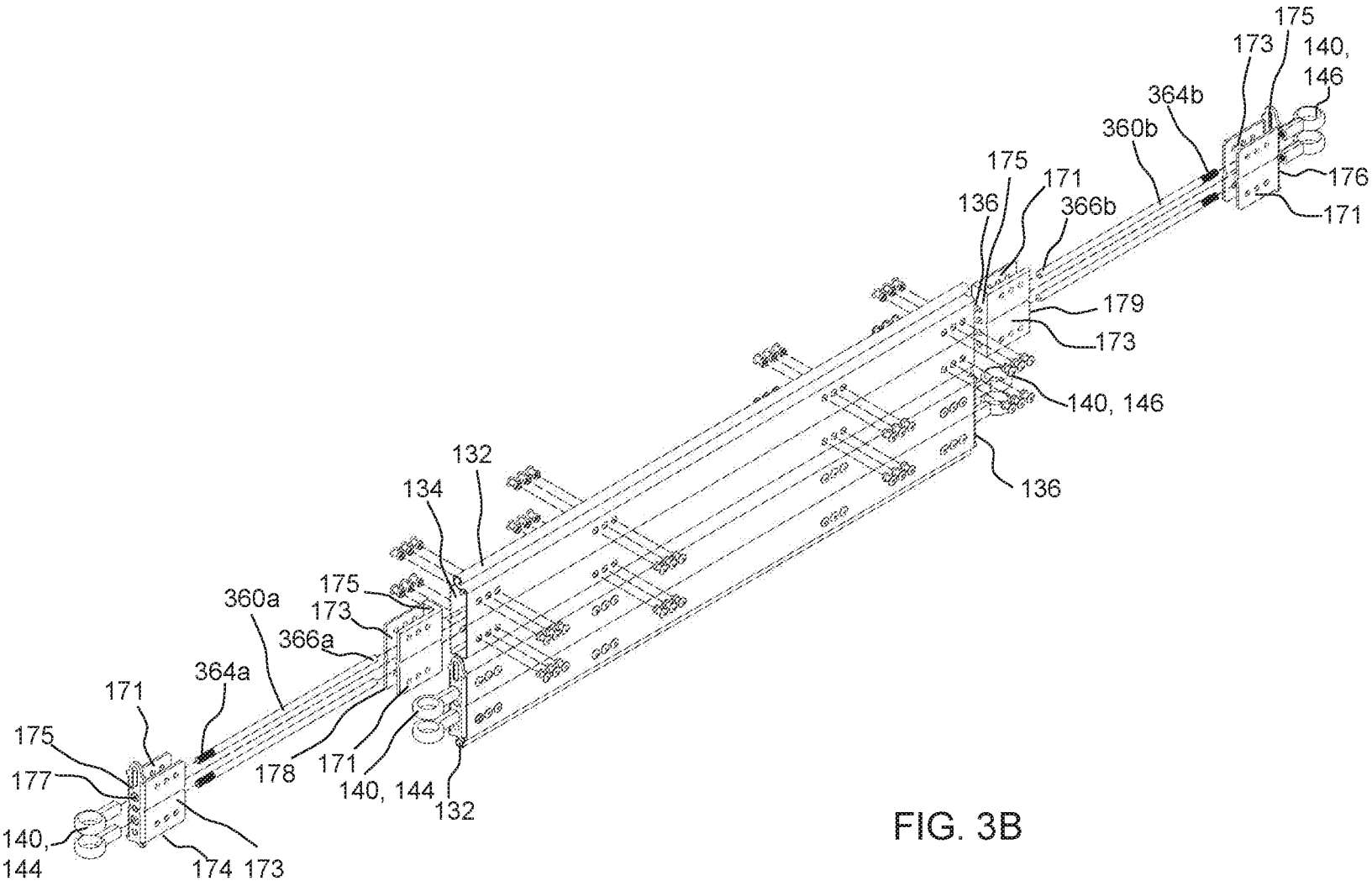
FIG. 3B shows the two pivotally interlocked elongate slats of FIG. 3A with one of the elongate slats in an exploded view according to various embodiments.

According to various embodiments, the roller shutter 100 may further include a plurality of elongate reinforcing members 260, 360*a*, 360*b* (see FIG. 3A and FIG. 3B). According to various embodiments, each of the plurality of elongate reinforcing members 260, 360*a*, 360*b* may include, but not limited to, a rod, a pole, a bar, a tube, a wire, a cable, or a cord. According to various embodiments, each of the elongate slats 130 may include at least one elongate reinforcing member 260, 360*a*, 360*b* extending within said elongate slat 130 in a manner so as to be aligned longitudinally to said elongate slat 130. According to various embodiments, the at least one elongate reinforcing member 260, 360*a*, 360*b* of each elongate slat 130 may be enclosed inside said elongate slat 130 and may be oriented lengthwise with respect to said elongate slat 130 so as to be parallel to the longitudinal direction of said elongate slat 130. According to various embodiments, the at least one elongate reinforcing member 260, 360*a*, 360*b* of each elongate slat 130 may be secured or coupled to said elongate slat 130 in a manner so as to strengthen or toughen said elongate slat 130. Accordingly, the at least one elongate reinforcing member 260, 360*a*, 360*b* of each elongate slat 130 may serve to support said elongate slat 130 to enhance its resistance against an impact force and/or to mitigate the impact force.

According to various embodiments, as shown in FIG. 2A and FIG. 2B, the at least one elongate reinforcing member 260 of at least one elongate slat 130 may extend across an entire length of said elongate slat 130. Accordingly, the at least one elongate reinforcing member 260 may span across a full length of the at least one elongate slat 130. Hence, a first longitudinal end 264 of the at least one elongate reinforcing member 260 may be joined to the first longitudinal end portion 134 of the at least one elongate slat 130 and a second longitudinal end 266 of the at least one elongate reinforcing member 260 may be joined to the second longitudinal end portion 136 of the at least one elongate slat 130. According to various embodiments, the first longitudinal end 264 of the at least one elongate reinforcing member 260 may be fixedly coupled to the first longitudinal end portion 134 of the at least one elongate slat 130 and the second longitudinal end 266 of the at least one elongate reinforcing member 260 may be fixedly coupled to the second longitudinal end portion 136 of the at least one elongate slat 130.

According to various embodiments, as shown in FIG. 2A and FIG. 2B, the at least one eyelet-structure 140 of each longitudinal end portion 134, 136 of the at least one elongate slat 130 may be integral with the at least one reinforcing member 260 extending within the at least one elongate slat 130. According to various embodiments, the at least one eyelet-structure 140 of the first longitudinal end portion 134 of the at least one elongate slat 130 may be integrally connected to the first longitudinal end 264 of the at least one elongate reinforcing member 260 and the at least one eyelet-structure 140 of the second longitudinal end portion 136 of the at least one elongate slat 130 may be integrally connected to the second longitudinal end 266 of the at least one elongate reinforcing member 260. Accordingly, the at least one eyelet-structure 140 of the first longitudinal end portion 134 of the at least one elongate slat 130, the at least one eyelet-structure 140 of the second longitudinal end portion 136 of the at least one elongate slat 130, and the at least one elongate reinforcing member 260 may be integrated or joined in such a way as to form a single unit which may serve to provide additional securing points and/or holding points for the at least one elongate slat 130 and to strengthen the at least one elongate slat 130 to enhance resistance against an impact force and/or to mitigate the impact force.

According to various embodiments, as shown in FIG. 2A and FIG. 2B, the at least one elongate slat 130 may include a first longitudinal end cover 174 and a second longitudinal end cover 176. According to various embodiments, the first longitudinal end cover 174 may be fixedly coupled to the first longitudinal end portion 134 of the at least one elongate slat 130, and the second longitudinal end cover 176 may be fixedly coupled to the second longitudinal end portion 136 of the at least one elongate slat 130. According to various embodiments, the first longitudinal end cover 174 and the second longitudinal end cover 176 each may be a U-shaped bracket having a pair of parallel wall portions 171, 173 and a interconnecting base portion 175. According to various embodiments, the first longitudinal end cover 174 and the second longitudinal end cover 176 may respectively be coupled to the first and second longitudinal end portions 134, 136 with respective pair of parallel wall portions 171, 173 thereof fixed to respective main inner walls of the at least one elongate slat 130. According to various embodiments, the respective pair of parallel wall portions 171, 173 may be fixed to respective main inner walls of the at least one elongate slat 130 via at least one fastener including, but not limited to, a rivet, a screw and a nut pair, or a bolt and a nut pair. According to various embodiments, the respective pair of parallel wall portions 171, 173 may be fixed to respective main inner walls of the at least one elongate slat 130 via three fasteners arranged in a row directed in the longitudinal direction of the at least one elongate slat 130.

According to various embodiments, the interconnecting base portion 175 of the first and second longitudinal end portions 134, 136 may include at least one hole 177. According to various embodiments, the at least one reinforcing member 260 may be inserted through the at least one hole 177 of the interconnecting base portion 175 so as to be extending within the at least one elongate slat 130. According to various embodiments, the at least one eyelet-structure 140 at the first longitudinal end portion 134 of the at least one elongate slat 130 may then be fastened or bond to the first longitudinal end 264 of the at least one elongate reinforcing member 260 and the at least one eyelet-structure 140 at the second longitudinal end portion 136 of the at least one elongate slat 130 may then be fastened or bond to the second longitudinal end 266 of the at least one elongate reinforcing member 260. Accordingly, in this manner, the first longitudinal end 264 of the at least one elongate reinforcing member 260 may be joined to the first longitudinal end portion 134 of the at least one elongate slat 130 via the first longitudinal end cover 174 and the at least one eyelet-structure 140 at the first longitudinal end portion 134, and the second longitudinal end 266 of the at least one elongate reinforcing member 260 may be joined to the second longitudinal end portion 136 of the at least one elongate slat 130 via the second longitudinal end cover 176 and the at least one eyelet-structure 140 at the second longitudinal end portion 136.

According to various embodiments, as shown in FIG. 2A and FIG. 2B, the at least one elongate reinforcing member 260 of the at least one elongate slat 130 may include two identical elongate reinforcing member 260, each may extend across an entire length of said elongate slat 130. According to various embodiments, the two identical elongate reinforcing member 260 may be joined to the at least one elongate slat 130 in the same manner.

FIG. 3A shows two pivotally interlocked elongate slats 130 of the shutter curtain 120 of the roller shutter 100 of FIG. 1 with a surface of one of the elongate slats 130 cutaway to show a variant of an interior of said elongate slat 130 according to various embodiments. FIG. 3B shows the two pivotally interlocked elongate slats 130 of FIG. 3A with one of the elongate slats 130 in an exploded view according to various embodiments.

According to various embodiments, as shown in FIG. 3A and FIG. 3B, the at least one elongate slat 130 may include a first elongate reinforcing member 360*a* and a second elongate reinforcing member 360*b*. According to various embodiments, the first elongate reinforcing member 360*a* may extend longitudinally inwards from the first longitudinal end portion 134 of the at least one elongate slat 130 and the second elongate reinforcing member 360*b* may extend longitudinally inwards from the second longitudinal end portion 136 of the at least one elongate slat 130. According to various embodiments, the first elongate reinforcing member 360*a* may extend longitudinally inwards for more than a tenth of a length, or a fifth of a length, or a quarter of a length of the at least one elongate slat 130 and the second elongate reinforcing member 360*b* may extend longitudinally inwards for more than a tenth of a length, or a fifth of a length, or a quarter of a length of the at least one elongate slat 130. Accordingly, the first elongate reinforcing member 360*a* may have a span of more than a tenth, or a fifth, or a quarter of the length of the at least one elongate slat 130 and a first longitudinal end 364*a* of the first elongate reinforcing member 360*a* may be joined to the first longitudinal end portion 134 of the at least one elongate slat 130 in a manner such that the first elongate reinforcing member 360*a* may be directed longitudinally inward, and the second elongate reinforcing member 360*b* may have a span of more than a tenth, or a fifth, or a quarter of the length of the at least one elongate slat 130 and a first longitudinal end 364*b* of the second elongate reinforcing member 360*b* may be joined to the second longitudinal end portion 136 of the at least one elongate slat 130 in a manner such that the second elongate reinforcing member 360*b* is directed longitudinally inward. According to various embodiments, a second longitudinal end 366*a* of the first elongate reinforcing member 360*a* may be joined to the at least one elongate slat 130 and a second longitudinal end 366*b* of the second elongate reinforcing member 360*b* may be joined to the at least one elongate slat 130. According to various embodiments, the first elongate reinforcing member 360*a* may be fixedly coupled to the at least one elongate slat 130 and the second elongate reinforcing member 360*b* may be fixedly coupled to the at least one elongate slat 130.

According to various embodiments, as shown in FIG. 3A and FIG. 3B, the at least one eyelet-structure 140 of the first longitudinal end portion 134 of the at least one elongate slat 130 may be integral with the first elongate reinforcing member 360*a*, and the at least one eyelet-structure 140 of the second longitudinal end portion 136 of the at least one elongate slat 130 may be integral with the second elongate reinforcing member 360*b*. According to various embodiments, the at least one eyelet-structure 140 of the first longitudinal end portion 134 of the at least one elongate slat 130 may be integrally connected to the first longitudinal end 364*a* of the first elongate reinforcing member 360*a* and the at least one eyelet-structure 140 of the second longitudinal end portion 136 of the at least one elongate slat 130 may be integrally connected to the first longitudinal end 364*b* of the second elongate reinforcing member 360*b*. Accordingly, the at least one eyelet-structure 140 of the first longitudinal end portion 134 of the at least one elongate slat 130 and the first elongate reinforcing member 360*a* may be integrated or joined in such a way as to form a first single unit, and the at least one eyelet-structure 140 of the second longitudinal end portion 136 of the at least one elongate slat 130 and the second elongate reinforcing member 360*b* may be integrated or joined in such a way as to form a second single unit. According to various embodiments, the first single unit and the second single unit may cooperatively serve to provide additional securing points and/or holding points for the at least one elongate slat 130 and to strengthen the at least one elongate slat 130 to enhance resistance against an impact force and/or to mitigate the impact force.

According to various embodiments, as shown in FIG. 3A and FIG. 3B, the at least one elongate slat 130 may include a first longitudinal end cover 174 and a second longitudinal end cover 176. Further, the at least one elongate slat 130 may include a first intermediate bracket 178 and a second intermediate bracket 179. According to various embodiments, the first longitudinal end cover 174 may be fixedly coupled to the first longitudinal end portion 134 of the at least one elongate slat 130, and the second longitudinal end cover 176 may be fixedly coupled to the second longitudinal end portion 136 of the at least one elongate slat 130. According to various embodiments, the first intermediate bracket 178 and the second intermediate bracket 179 each may be inserted inside the at least one elongate slat 130 and may be fixedly coupled to a predetermined position inside the at least one elongate slat 130. According to various embodiments, the first intermediate bracket 178 may be positioned at a predetermined distance from the first longitudinal end cover 174 and the second intermediate bracket 179 may be positioned at a predetermined distance from the second longitudinal end cover 176. According to various embodiments, the first longitudinal end cover 174, the second longitudinal end cover 176, the first intermediate bracket 178, and the second intermediate bracket 179 each may be a U-shaped bracket having a pair of parallel wall portions 171, 173 and a interconnecting base portion 175. According to various embodiments, the first longitudinal end cover 174 and the second longitudinal end cover 176 may respectively be coupled to the first and second longitudinal end portions 134, 136 with respective pair of parallel wall portions 171, 173 thereof fixed to respective main inner walls of the at least one elongate slat 130. According to various embodiments, the first intermediate bracket 178 and the second intermediate bracket 179 may also be coupled to the at least one elongate slat 130 with respective pair of parallel wall portions 171, 173 thereof fixed to respective main inner walls of the at least one elongate slat 130. According to various embodiments, the respective pair of parallel wall portions 171, 173 may be fixed to respective main inner walls of the at least one elongate slat 130 via at least one fastener including, but not limited to, a rivet, a screw and a nut pair, or a bolt and a nut pair. According to various embodiments, the respective pair of parallel wall portions 171, 173 may be fixed to respective main inner walls of the at least one elongate slat 130 via three fasteners arranged in a row directed in the longitudinal direction of the at least one elongate slat 130.

According to various embodiments, the interconnecting base portion 175 of the first and second longitudinal end portions 134, 136 as well as the first and second intermediate brackets 178, 179 may include at least one hole 177. According to various embodiments, the first reinforcing member 360*a* may be inserted through the at least one hole 177 of the interconnecting base portion 175 of the first longitudinal end cover 174 so as to be extending longitudinally inwards from the first longitudinal end portion 134 of the at least one elongate slat 130. According to various embodiments, the second reinforcing member 360*b* may be inserted through the at least one hole 177 of the interconnecting base portion 175 of the second longitudinal end cover 176 so as to be extending longitudinally inwards from the second longitudinal end portion 136 of the at least one elongate slat 130. According to various embodiments, the at least one eyelet-structure 140 at the first longitudinal end portion 134 of the at least one elongate slat 130 may then be fastened or bond to the first longitudinal end 364*a* of the first elongate reinforcing member 360*a* and the at least one eyelet-structure 140 at the second longitudinal end portion 136 of the at least one elongate slat 130 may then be fastened or bond to the first longitudinal end 364*b* of the second elongate reinforcing member 360*b*. According to various embodiments, the second longitudinal end 366*a* of the first elongate reinforcing member 360*a* may be fastened or bonded to the at least one hole 177 of the interconnecting base portion 175 of the first intermediate bracket 178, and the second longitudinal end 366*b* of the second elongate reinforcing member 360*b* may be fastened or bonded to the at least one hole 177 of the interconnecting base portion 175 of the second intermediate bracket 179. Accordingly, in this manner, the first elongate reinforcing member 360*a* may be joined to the at least one elongate slat 130 via the first longitudinal end cover 174, the at least one eyelet-structure 140 at the first longitudinal end portion 134 and the first intermediate bracket 178. Further, the second elongate reinforcing member 360*b* may be joined to the at least one elongate slat 130 via the second longitudinal end cover 176, the at least one eyelet-structure 140 at the second longitudinal end portion 136 and the second intermediate bracket 179.

According to various embodiments, as shown in FIG. 3A and FIG. 3B, the at least one elongate slat 130 may include two identical pairs of the first and second elongate reinforcing members 360*a*, 360*b*. According to various embodiments, the two identical pairs of the first and second elongate reinforcing members 360*a*, 360*b* may be joined to the at least one elongate slat 130 in the same manner.

According to various embodiments, each of the elongate slats 130 of the shutter curtain 120 of the roller shutter 100 may include the at least one elongate reinforcing member 260 of FIG. 2A and FIG. 2B which extends across an entire length of said elongate slat 130. According to various embodiments, each of the elongate slats 130 of the shutter curtain 120 of the roller shutter 100 may include the first and second elongate reinforcing members 360*a*, 360*b* of FIG. 3A and FIG. 3B. According to various embodiments, the series of three of more elongate slats 130 of the shutter curtain 120 of the roller shutter 100 may include at least one elongate slat 130 having the at least one elongate reinforcing member 260 of FIG. 2A and FIG. 2B which extends across an entire length of said elongate slat 130 and at least one elongate slat 130 having the first and the second elongate reinforcing members 360*a*, 360*b* of FIG. 3A and FIG. 3B.

Figure 4B:
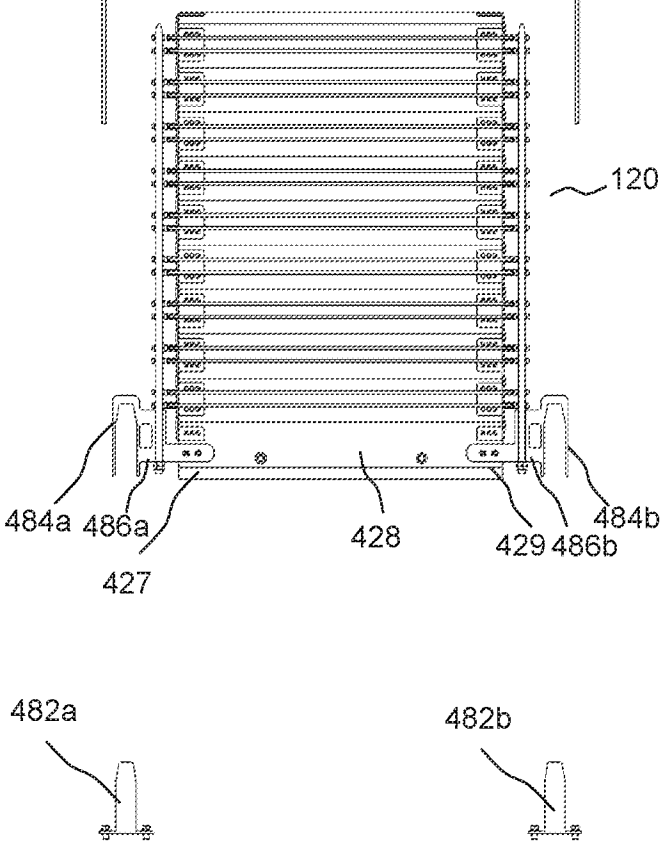
FIG. 4B shows a cross sectional view of the shutter curtain of the roller shutter of FIG. 1 when the shutter curtain is partially lowered according to various embodiments.
Figure 4A:
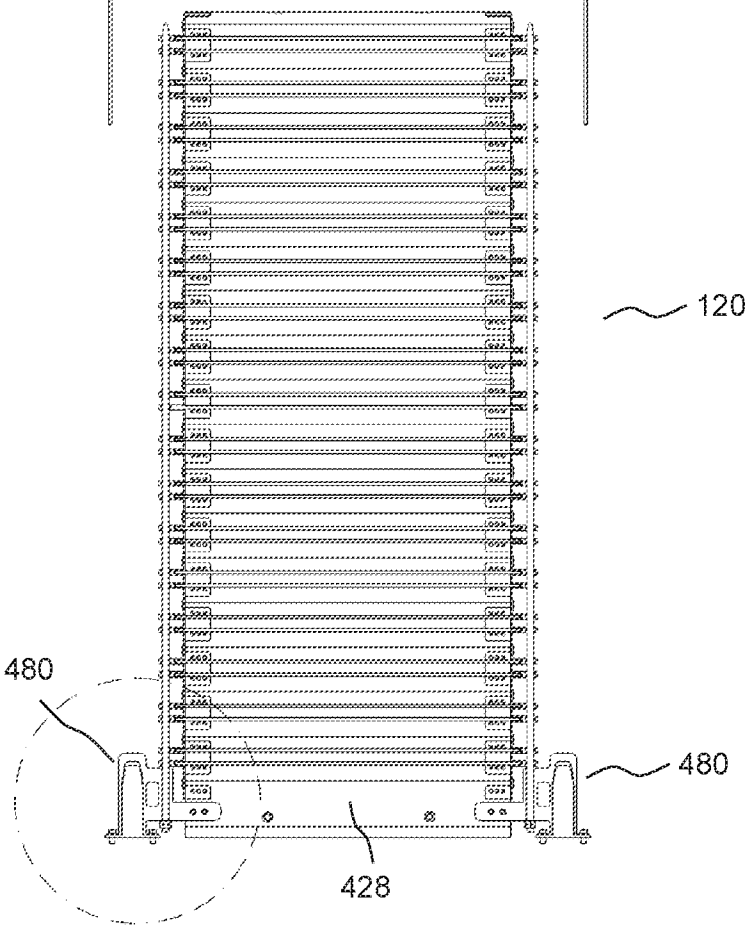
FIG. 4A shows a cross sectional view of the shutter curtain of the roller shutter of FIG. 1 when the shutter curtain is fully lowered according to various embodiments.
Figure 4C:
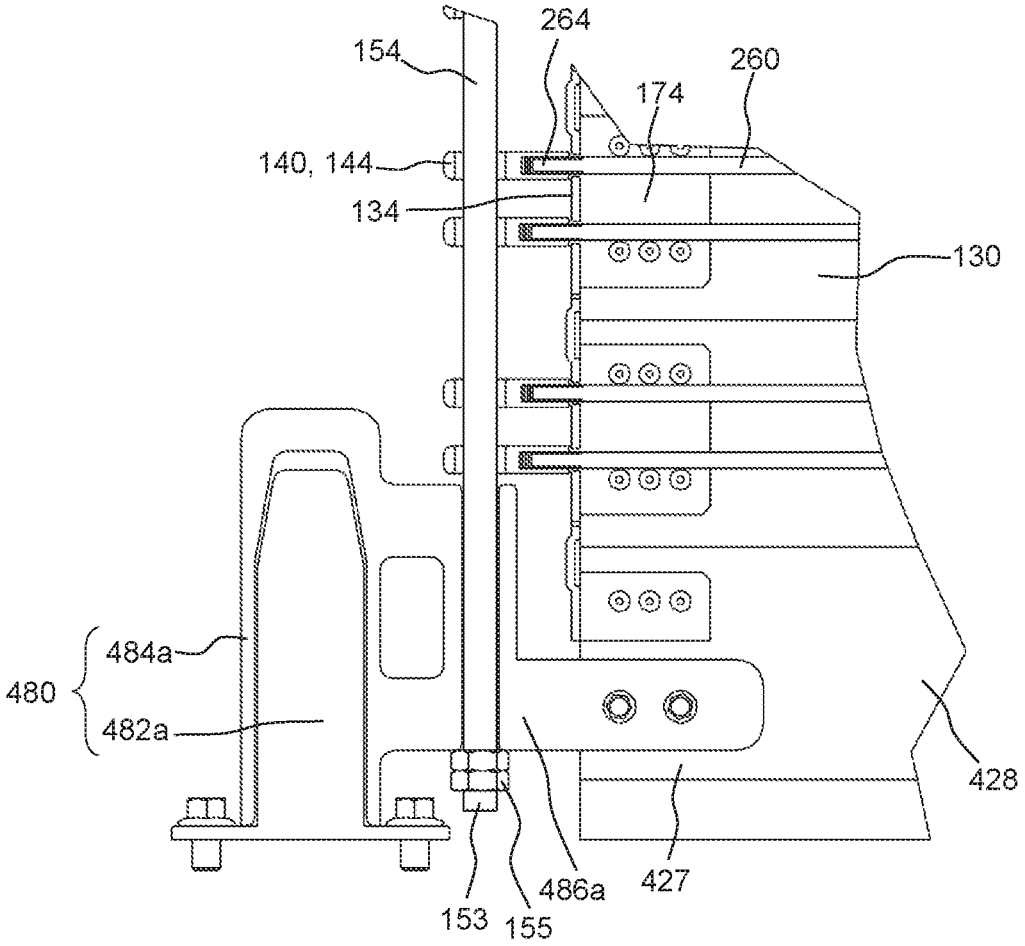
FIG. 4C shows an enlarged view of the circled portion in FIG. 4A illustrating an retaining arrangement according to various embodiments.

FIG. 4A shows a cross sectional view of the shutter curtain 120 of the roller shutter 100 of FIG. 1 when the shutter curtain 120 is fully lowered according to various embodiments. FIG. 4B shows a cross sectional view of the shutter curtain 120 of the roller shutter 100 of FIG. 1 when the shutter curtain 120 is partially lowered according to various embodiments. FIG. 4C shows an enlarged view of the circled portion in FIG. 4A illustrating a retaining arrangement 480 (or a retaining-and-alignment arrangement) of the roller shutter 100 according to various embodiments.

According to various embodiments, the roller shutter 100 may further include the retaining arrangement 480 (or the retaining-and-alignment arrangement) configured to align a bottom rail 428 of the shutter curtain 120 to a predetermined position on a ground and to retain or restrain the bottom rail 428 from sideways or lateral movements in said position when the shutter curtain 120 is lowered. According to various embodiments, the retaining arrangement 480 may be configured such that the bottom rail 428 of the shutter curtain 120 may be brought into alignment with the predetermined position on the ground as the shutter curtain 120 is being lowered. Further, the retaining arrangement 480 may be configured such that the bottom rail 428 may not be easily moved out of alignment (or moved sideways or moved laterally) or may be held in place with respect to horizontal movement once the shutter curtain 120 is fully lowered. Accordingly, the retaining arrangement 480 may be configured for laterally retaining the bottom rail 428 against sideways, or horizontal, or lateral movements.

According to various embodiments, the retaining arrangement 480 may include two bollards 482*a*, 482*b* fixed to the ground and two corresponding caps 484*a*, 484*b* attached to the bottom rail 428 of the shutter curtain 120. According to various embodiments, as the two corresponding caps 484*a*, 484*b* fit over the two bollards 482*a*, 482*b* when the shutter curtain 120 is lowering, the bottom rail 428 of the shutter curtain 120 may be adjusted according to a straight line joining the two bollards 482*a*, 482*b*. According to various embodiments, each of the two bollards 482*a*, 482*b* may include, but not limited to, a conical bollard or a frusto-conical bollard. According to various embodiments, each of the two bollards 482*a*, 482*b* may have a height higher than a height of the bottom rail 428 of the shutter curtain 120. According to various embodiments, each of the two corresponding caps 484*a*, 484*b* may include a cavity with a shape that correspond to the shape of the bollard 482*a*, 482*b* which the corresponding cap 484*a*, 484*b* is to be fitted on. According to various embodiments, the two bollards 482*a*, 482*b* may be fixed to the ground in a spaced apart manner such that, when the shutter curtain is lowered, a first bollard 482*a* may be adjacent a first longitudinal end 427 of the bottom rail 428 of the shutter curtain 120 and a second bollard 482*b* may be adjacent to a second longitudinal end 429 of the bottom rail 428 of the shutter curtain 120. Accordingly, the first cap 484*a* may be attached, via a first connecting portion 486*a*, to the first longitudinal end 427 of the bottom rail 428 of the shutter curtain 120 and the second cap 484*b* may be attached, via a second connecting portion 486*b*, to the second longitudinal end 429 of the bottom rail 428 of the shutter curtain 120.

According to various embodiments, the second cord end 153 of the respective cords 154, 156 may be threaded through the first and second connecting portions 486*a*, 486*b* respectively. According to various embodiments, the stopper element 155 of the second cord end 153 of the respective cords 154, 156 may be configured to retain or confine the bottom rail 428 within the length of the respective cords 154,156. According to various embodiments, the stopper element 155 of the second cord end 153 of the respective cords 154, 156 may serve as a physical barrier to restrain or restrict or obstruct the respective first and second connecting portions 486*a*, 486*b* from sliding out from the second cord end 153 of the respective cords 154, 156. With the second cord end 153 of the respective cords 154, 156 being coupled to the bottom rail 428 and the first and second cap 484*a*, 484*b* via the respective first and second connecting portion 486*a*, 486*b*, the second cord end 153 of the respective cords 154, 156 may be restrained by the retaining arrangement 480 from sideways or lateral movements due to the bottom rail 428 being restrained or retained by the retaining arrangement 480 when the shutter curtain 120 is lowered. According to various embodiments, with the first and second cords 154, 156 extending from the rotatable drum 110 to the bottom rail 428, all the slats 130 of the shutter curtain 120 (including the bottom rail 428) may be confined within the length of the respective cords 154, 156. Accordingly, when the shutter curtain 120 is lowered, the shutter curtain 120 may weigh down the second cord end 153 of the respective cords 154, 156 to the ground. Hence, the respective cords 154, 156 may be extending from the rotatable drum 110 to the ground such that the respective cords 154, 156 may provide additional support to the shutter curtain 120 in a manner so as to mitigate impact force applied on the shutter curtain 120.

Figure 5:
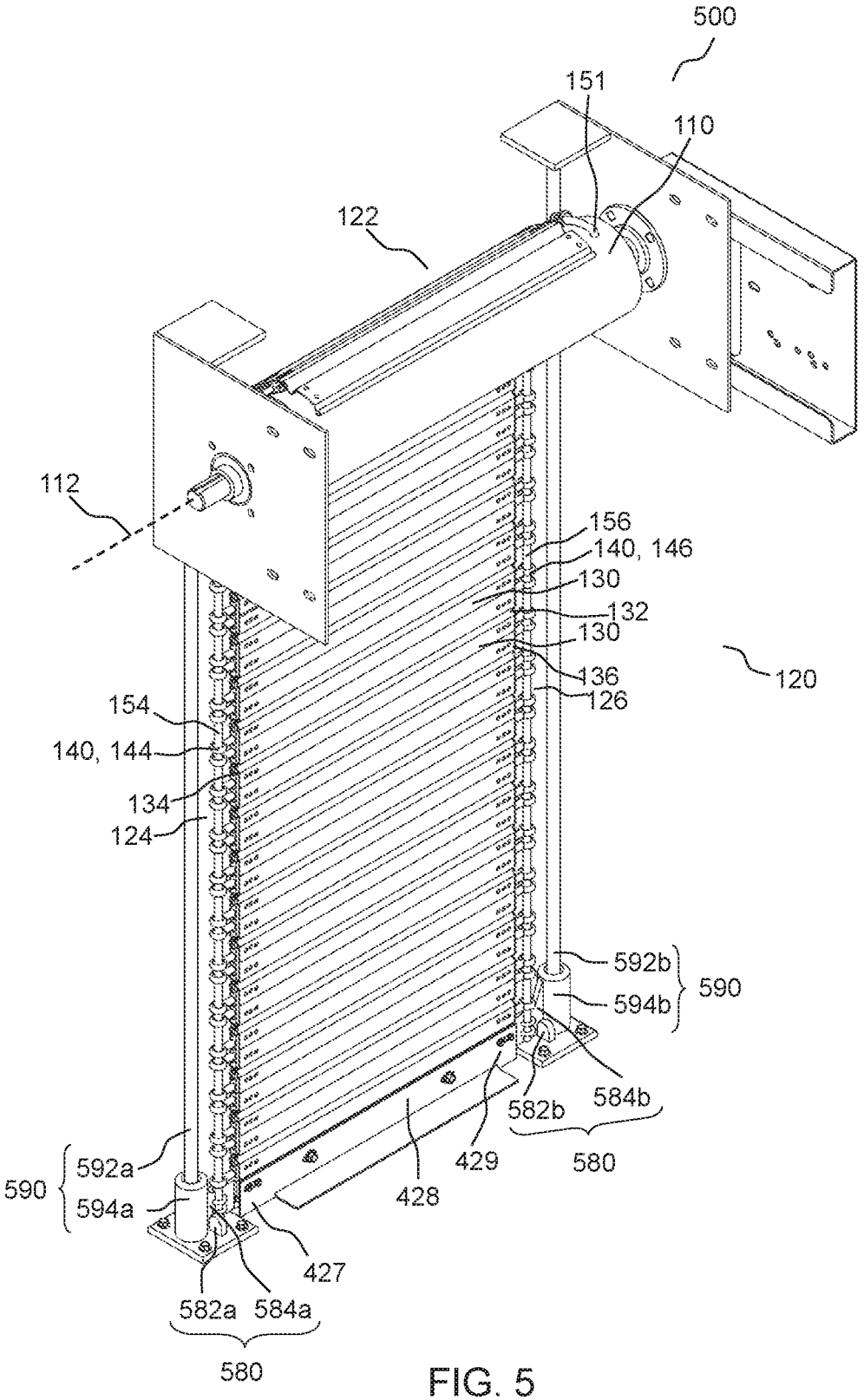
FIG. 5 shows a roller shutter according to various embodiments.
Figure 6B:
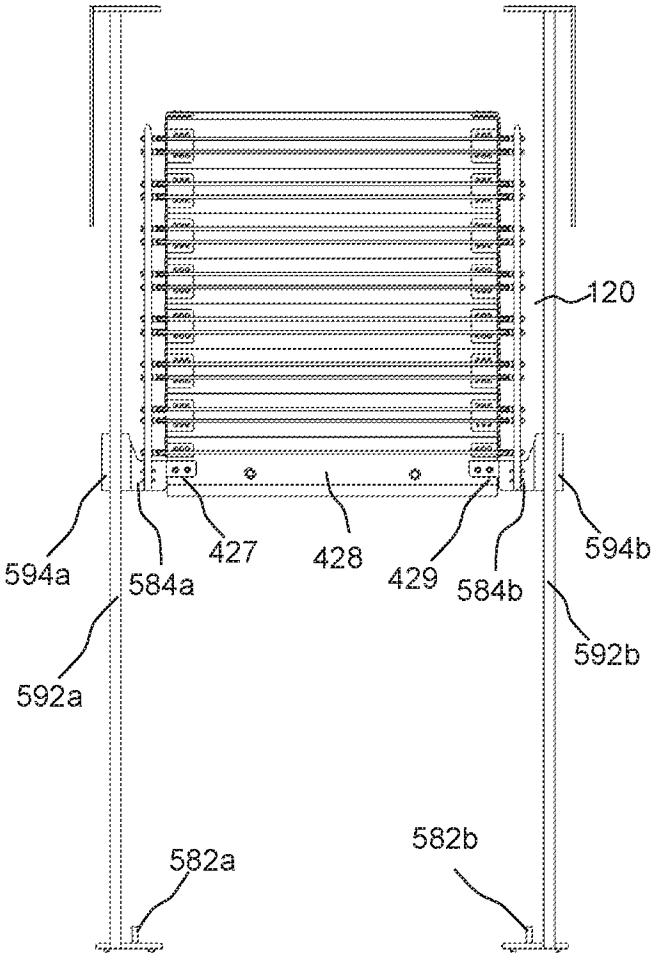
FIG. 6B shows a shows a cross sectional view of the shutter curtain of the roller shutter of FIG. 6A when the shutter curtain is partially lowered according to various embodiments.
Figure 6A:
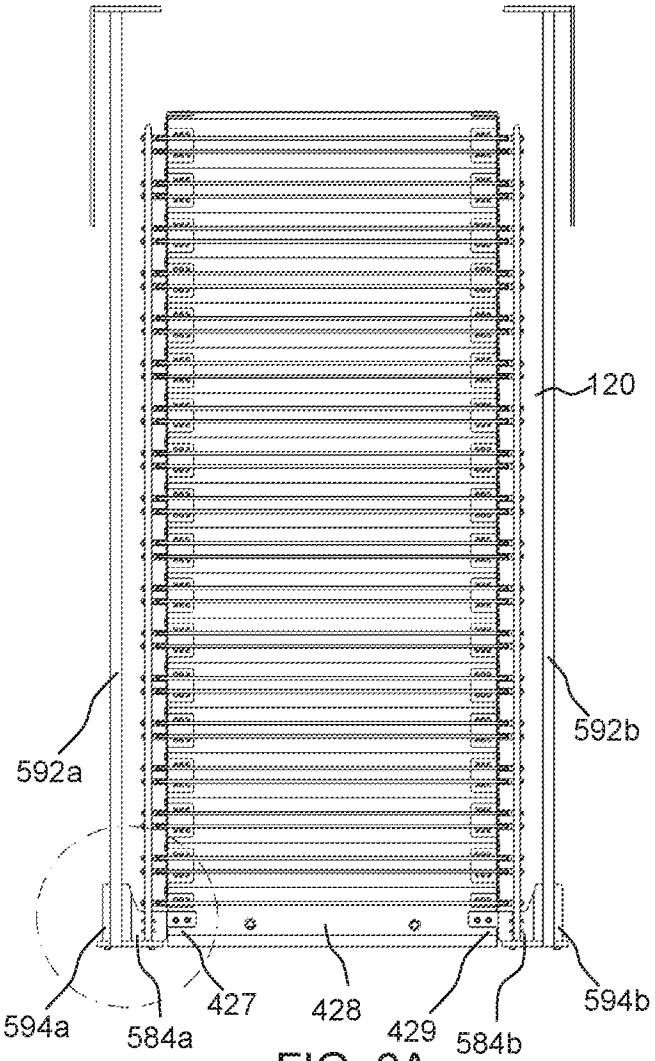
FIG. 6A shows a cross sectional view of the shutter curtain of the roller shutter of FIG. 5 when the shutter curtain is fully lowered according to various embodiments.
Figure 6C:
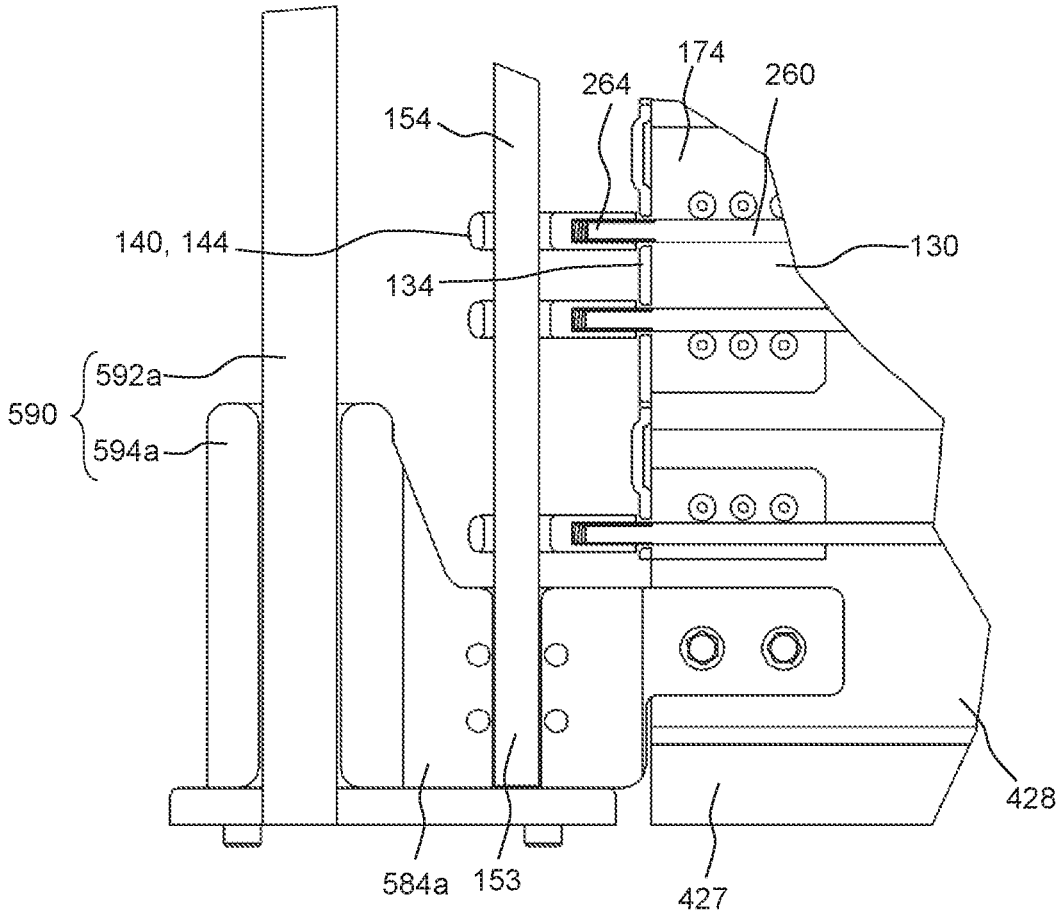
FIG. 6C shows an enlarged view of the circled portion in FIG. 6A illustrating a retaining arrangement according to various embodiments.

FIG. 5 shows a roller shutter 500 according to various embodiments. FIG. 6A shows a cross sectional view of the shutter curtain 120 of the roller shutter 500 of FIG. 5 when the shutter curtain 120 is fully lowered according to various embodiments. FIG. 6B shows a shows a cross sectional view of the shutter curtain 120 of the roller shutter 500 of FIG. 6A when the shutter curtain 120 is partially lowered according to various embodiments. FIG. 6C shows an enlarged view of the circled portion in FIG. 6A illustrating a retaining arrangement 580 according to various embodiments. According to various embodiments, the roller shutter 500 of FIG. 5 may, similar to the roller shutter 100 of FIG. 1, be configured for mitigating an impact force applied to the roller shutter 500. According to various embodiments, the roller shutter 500 of FIG. 5 may be similar to the roller shutter 100 of FIG. 1 in all aspect, except that the roller shutter 500 of FIG. 5 includes the retaining arrangement 580 (or the retaining-and-alignment arrangement) which is different from the retaining arrangement 480 of the roller shutter 100 as shown in FIG. 4A to FIG. 4C and that the roller shutter 500 of FIG. 5 further include a sliding guide arrangement 590. According to various embodiments, the roller shutter 500 of FIG. 5 may, similar to the roller shutter 100 of FIG. 1, include, inter alia, the rotatable drum 110; the shutter curtain 120 having the series of three or more elongate slats 130; the first row 144 of eyelet-structures 140 and the second row 146 of eyelet-structures 140 formed along the first and second side borders 124, 126, respectively, of the shutter curtain 120; the at least one elongate reinforcing member 260, 360*a*, 360*b* extending within each elongate slat 130; and the first longitudinal end cover 174 and the second longitudinal end cover 176 coupled to each elongate slat 130.

According to various embodiments, the roller shutter 500 may include the retaining arrangement 580 (or the retaining-and-alignment arrangement). According to various embodiments, the retaining arrangement 580 may, similar to the retaining arrangement 480 of FIG. 4A to FIG. 4C, be configured to align a bottom rail 428 of the shutter curtain 120 to a predetermined position on a ground and to retain or restrain the bottom rail 428 from sideways or lateral movements in said position when the shutter curtain 120 is lowered. According to various embodiments, the retaining arrangement 580 may, similar to the retaining arrangement 480 of FIG. 4A to FIG. 4C, be configured such that the bottom rail 428 of the shutter curtain 120 may be brought into alignment with the predetermined position on the ground as the shutter curtain 120 is being lowered. Further, the retaining arrangement 580 may, similar to the retaining arrangement 480 of FIG. 4A to FIG. 4C, be configured such that the bottom rail 428 may not be easily moved out of alignment (or moved sideways or moved laterally) once the shutter curtain 120 is fully lowered. Accordingly, the retaining arrangement 580 may be configured for laterally retaining the bottom rail 428 against sideways, or horizontal, or lateral movements.

According to various embodiments, the alignment arrangement 580 may differ from the alignment arrangement 480 of FIG. 4A to FIG. 4C, in that the retaining arrangement 580 may include two brackets 582*a*, 582*b*, each bracket

582*a*, 582*b* having a Y-shaped slot, fixed to the ground and two corresponding insert members 584*a*, 584*b* attached to the bottom rail 428 of the shutter curtain 120. According to various embodiments, as the two corresponding insert members 584*a*, 584*b* fit into the two brackets 582*a*, 582*b* when the shutter curtain 120 is lowering, the bottom rail 428 of the shutter curtain 120 may be adjusted according to a straight line joining the two brackets 582*a*, 582*b*. According to various embodiments, each of the two corresponding insert members 584*a*, 584*b* may have a thickness that correspond to a thickness of the slot of the respective bracket 582*a*, 582*b* which the corresponding insert member 584*a*, 584*b* is to be fitted into or inserted. According to various embodiments, the two brackets 582*a*, 582*b* may be fixed to the ground in a spaced apart manner such that, when the shutter curtain is lowered, a first bracket 582*a* may be adjacent a first longitudinal end 427 of the bottom rail 428 of the shutter curtain 120 and a second bracket 582*b* may be adjacent to a second longitudinal end 429 of the bottom rail 428 of the shutter curtain 120. Accordingly, a first insert members 584*a* may be attached to the first longitudinal end 427 of the bottom rail 428 of the shutter curtain 120 and a second insert members 584*b* may be attached to the second longitudinal end 429 of the bottom rail 428 of the shutter curtain 120.

According to various embodiments, the second cord end 153 of the respective cords 154, 156 may be coupled to the respective first and second insert members 584*a*, 584*b*. According to various embodiments, the respective first and second insert members 584*a*, 584*b* may respectively serve as the stopper element 155 of the second cord end 153 of the respective cords 154, 156. Accordingly, the stopper element 155 of the second cord end 153 of the respective cords 154, 156 may respectively serve as a physical barrier to restrain or restrict or obstruct the respective rows of eyelet-structures 140 from sliding out from the second cord end 153 of the respective cords 154, 156. With the second cord end 153 of the respective cords 154, 156 being coupled to the bottom rail 428, via the respective first and second insert members 584*a*, 584*b*, the second cord end 153 of the respective cords 154, 156 may be restrained by the retaining arrangement 580 from sideways or lateral movements due to the bottom rail 428 being restrained or retained by the retaining arrangement 580 when the shutter curtain 120 is lowered. According to various embodiments, with the first and second cords 154, 156 extending from the rotatable drum 110 to the bottom rail 428, all the slats 130 of the shutter curtain 120 may be confined within the length of the respective cords 154, 156. Accordingly, when the shutter curtain 120 is lowered, the shutter curtain 120 may weigh down the second cord end 153 of the respective cords 154, 156 to the ground. Hence, the respective cords 154, 156 may be extending from the rotatable drum 110 to the ground such that the respective cords 154, 156 may provide additional support to the shutter curtain 120 in a manner so as to mitigate impact force applied on the shutter curtain 120.

According to various embodiments, the roller shutter 500 may further include a sliding guide arrangement 590 which may include a first guiding rod 592*a* and a second guiding rod 592*b* fixed to the ground in an upright orientation and spaced apart in a manner so as to be respectively disposed adjacent the first and second side borders 124, 126, respectively, of the shutter curtain 120 when the shutter curtain 120 is lowered. Accordingly, the first guiding rod 592*a* and the second guiding rod 592*b* may be erected from the ground upwards and set apart from each other by a distance equivalent or close to a width of the shutter curtain 120 measured from the first side border 124 to the second side border 126.

According to various embodiments, the sliding guide arrangement 590 may further include a first sliding element 594*a* and a second sliding element 594*b* attached to the first longitudinal end 427 and the second longitudinal end 429, respectively, of the bottom rail 428 of the shutter curtain 120. Accordingly, the first sliding element 594*a* may be protruding from the first longitudinal end 427 of the bottom rail 428 of the shutter curtain 120 and the second sliding element 594*b* may be protruding from the second longitudinal end 429 of the bottom rail 428 of the shutter curtain 120. According to various embodiments, the first sliding element 594*a* may attached to the first longitudinal end 427 of the bottom rail 428 via the first insert member 584*a*, and the second sliding element 594*b* may be attached to the second longitudinal end 429 of the bottom rail 428 via the second insert member 584*b*. According to various embodiments, the first sliding element 594*a* may be in engagement with the first guiding rod 592*a* and the second sliding element 594*b* is in engagement with the second guiding rod 592*b*. According to various embodiments, each of the first and second sliding elements 594*a*, 594*b* may be of a hollow cylindrical shape having a central through-hole whereby the first guiding rod 592*a* is passed through the central through-hole of the first sliding element 594*a* and the second guiding rod 592*b* is passed through the central through-hole of the second sliding element 594*b* such that each of the first and second sliding elements 594*a*, 594*b* may slide along respective first and second guiding rod 592*a*, 592*b*.

Figure 7:
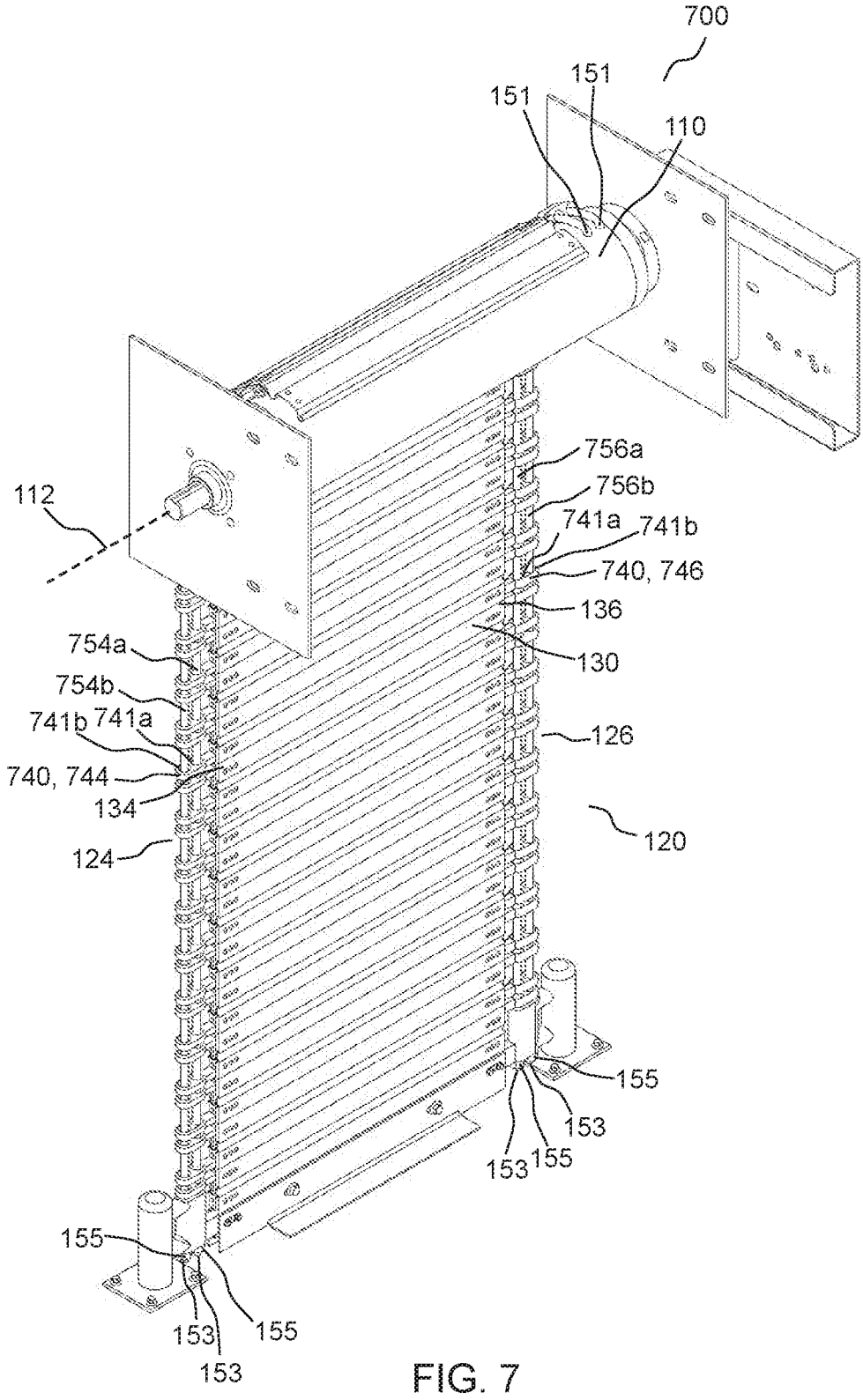
FIG. 7 shows a shows a roller shutter according to various embodiments.

FIG. 7 shows a roller shutter 700 according to various embodiments. According to various embodiments, the roller shutter 700 of FIG. 7 may, similar to the roller shutter 100 of FIG. 1, be configured for mitigating an impact force applied to the roller shutter 700. According to various embodiments, the roller shutter 700 of FIG. 7 may be similar to the roller shutter 100 of FIG. 1 in all aspect. According to various embodiments, the at least one eyelet structure of respective elongate slat of the roller shutter 700 of FIG. 7 may include at least one double-eyelets-structure 740. According to various embodiments the roller shutter 700 of FIG. 7 may include a first row 744 of double-eyelets-structures 740 and a second row 746 of double-eyelets-structures 740 formed along the first and second side borders 124, 126, respectively, of the shutter curtain 120.

According to various embodiments, the roller shutter 700 of FIG. 7 may, similar to the roller shutter 100 of FIG. 1, include the rotatable drum 110. According to various embodiments, the roller shutter 700 of FIG. 7 may, similar to the roller shutter 100 of FIG. 1, include the shutter curtain 120. According to various embodiments, the shutter curtain 120 be configured to be wound on and off the rotatable drum 110 in a manner so as to be raised or lowered for opening or closing an entrance.

According to various embodiments, the shutter curtain 120 of the roller shutter 700 of FIG. 7 may, similar to the roller shutter 100 of FIG. 1, include the series of three or more elongate slats 130. Accordingly, the three or more elongate slats 130 may be arranged in sequence to form a set of three or more successive elongate slats 130. According to various embodiments, the series of three or more elongate slats 130 may be pivotally interlocked in a longitudinal-edge-to-longitudinal-edge arrangement one after another. According to various embodiments, the series of three or more elongate slats 130 may be arranged parallel to the rotational axis 112 of the rotatable drum 110. According to various embodiments, the series of three or more elongate slats 130 may be capable of being wound on and off the rotatable drum 110 together in an interlocked state.

According to various embodiments, each of the elongate slats 130 of the shutter curtain 120 of the roller shutter 700 of FIG. 7 may, similar to the roller shutter 100 of FIG. 1, have the first longitudinal end portion 134 and the second longitudinal end portion 136. According to various embodiments, the first and second longitudinal end portions 134, 136 of each elongate slat 130 may be respective portions at respective extremity, lengthwise, of said elongate slat 130. According to various embodiments, the first and second longitudinal end portions 134, 136 may be respectively aligned to form the first side border 124 and the second side border 126, respectively, of the shutter curtain 120. According to various embodiments, all the first longitudinal end portions 134 of the series of three or more elongate slats 130 may be aligned or brought into alignment to form a continuous line so as to form the first side border 124 of the shutter curtain 120. According to various embodiments, all the second longitudinal end portions 136 of the series of three or more elongate slats 130 may be aligned or brought into alignment to form a continuous line so as to form the second side border 126 of the shutter curtain 120.

According to various embodiments, the first longitudinal end portion 134 and the second longitudinal end portion 136 of each elongate slat 130 of the series of three or more elongate slats 130 may be respectively provided with at least one double-eyelets-structure 740 which protrudes therefrom. According to various embodiments, each elongate slat 130 of the series of three or more elongate slats 130 may include at least one double-eyelets-structure 740 protruding or jutting out from the first longitudinal end portion 134 of said elongate slat 130. According to various embodiments, each elongate slat 130 of the series of three or more elongate slats 130 may include at least one double-eyelets-structure 740 protruding or jutting out from the second longitudinal end portion 136 of said elongate slat 130. Accordingly, every one of the three or more elongate slats 130 may include at least one double-eyelets-structure 740 protruding from respective first longitudinal end portion 134 thereof and at least one double-eyelets-structure 740 protruding from respective second longitudinal end portion 136 thereof.

According to various embodiments, each double-eyelets-structure 740 may include an elongate part extending longitudinally from respective elongate slat 130. According to various embodiments, the elongate part of said double-eyelets-structure 740 may be extending from respective longitudinal end portions 134, 136 of respective elongate slat 130 along the longitudinal direction of the respective elongate slat 130. According to various embodiments, the elongate part of said double-eyelets-structure 740 may include two eyeholes, an inner eyehole 741*a* and an outer eyehole 741*b*, forming the double eyelets. According to various embodiments, the inner eyehole 741*a* may be located proximal to the respective longitudinal end portions 134,135 of respective elongate slat 130 and the outer eyehole 741*b* may be located distal away from the respective longitudinal end portions 134,135 of respective elongate slat 130. According to various embodiments, the two eyeholes 741*a*, 741*b* may be lined abreast so as to be aligned side-by-side along the longitudinal direction of the respective elongate slat 130.

According to various embodiments, the first row 744 of double-eyelets-structures 740 and the second row 746 of double-eyelets-structures 740 may be formed along the first and second side borders 124, 126, respectively, of the shutter curtain 120. According to various embodiments, all the double-eyelets-structures 740 of all the first longitudinal end portions 134 of the series of three or more elongate slats 130 may be arranged or placed in succession into a line so as to make up the first row 744 of double-eyelets-structures 740 running alongside the first side border 124 of the shutter curtain 120. According to various embodiments, the inner eyeholes 741*a* (or inner holes) of all the double-eyelets-structures 740 of all the first longitudinal end portions 134 of the series of three or more elongate slats 130 may be in line with each other, and the outer eyeholes 741*b* (or outer holes) of all the double-eyelets-structures 740 of all the first longitudinal end portions 134 of the series of three or more elongate slats 130 may be in line with each other. According to various embodiments, all the double-eyelets-structures 740 of all the second longitudinal end portions 136 of the series of three or more elongate slats 130 may be arranged or placed in succession into a line so as to make up the second row 746 of double-eyelets-structures 740 running alongside the second side border 126 of the shutter curtain 120. According to various embodiments, the inner eyeholes 741*a* (or inner holes) of all the double-eyelets-structures 740 of all the second longitudinal end portions 136 of the series of three or more elongate slats 130 may be in line with each other, and outer eyeholes 741*b* (or outer holes) of all the double-eyelets-structures 740 of all the second longitudinal end portions 136 of the series of three or more elongate slats 130 may be in line with each other.

According to various embodiments, the roller shutter 700 of FIG. 7 may include a first inner cord 754*a*, a first outer cord 754*b*, a second inner cord 756*a* and a second outer cord 756*b*. Accordingly, the roller shutter 700 may include four cords 754*a*, 754*b*, 756*a*, 756*b*. According to various embodiments, each of the four cords 754*a*, 754*b*, 756*a*, 756*b* may include, but not limited to, a steel wire, a steel cable, or a steel cord. According to various embodiments, the first inner cord 754*a* may be strung loosely through all inner eyeholes 741*a* of the double-eyelets-structures 740 of the first row 744 of double-eyelets-structures 740. According to various embodiments, the first outer cord 754*b* may be strung loosely through all outer eyeholes 741*b* of the double-eyelets-structures 740 of the first row 744 of double-eyelets-structures 740. Accordingly, all the double-eyelets-structures 740 of the first row 744 of double-eyelets-structures 740 may be connected by the first inner cord 754*a* and the first outer cord 754*b* which are passed through or threaded through respective inner and outer eyeholes 741*a*, 741*b* of all the double-eyelets-structures 740 of the first row 744 of double-eyelets-structures 740. According to various embodiments, the second inner cord 756*a* may be strung loosely through all the inner eyeholes 741*a* of the second row 746 of double-eyelets-structures 740. According to various embodiments, the second outer cord 756*b* may be strung loosely through all the outer eyeholes 741*b* of the second row 746 of double-eyelets-structures 740. Accordingly, all the double-eyelets-structures 740 of the second row 746 of double-eyelets-structures 740 may be connected by the second inner cord 756*a* and second outer cord 756*b* which are passed through or threaded through respective inner and outer eyeholes 741*a*, 741*b* of all the double-eyelets-structures 740 of the second row 746 of double-eyelets-structures 740.

According to various embodiments, each of the four cords 754*a*, 754*b*, 756*a*, 756*b* may be configured to confine all double-eyelets-structures 740 of respective row 744, 746 of double-eyelets-structures 740 within a length of each cord 754*a*, 754*b*, 756*a*, 756*b*. According to various embodiments, the first inner cord 754*a* may be configured to keep or retain, via the inner eyeholes 741*a*, all the double-eyelets-structures 740 of the first row 744 of double-eyelets-structures 740 within bounds or limits as defined by the length of the first inner cord 754*a*. Accordingly, all the double-eyelets-structures 740 of the first row 744 of double-eyelets-structures 740 may be placed or put upon, via the inner eyeholes 741*a*, the first inner cord 754*a* in a manner so as to be non-separable from the first inner cord 754*a* and be restrained from sliding out of the first inner cord 754*a*. According to various embodiments, the first outer cord 754*b* may be configured to keep or retain, via the outer eyeholes 741*b*, all the double-eyelets-structures 740 of the first row 744 of double-eyelets-structures 740 within bounds or limits as defined by the length of the first outer cord 754*b*. Accordingly, all the double-eyelets-structures 740 of the first row 744 of double-eyelets-structures 740 may be placed or put upon, via the outer eyeholes 741*b*, the first outer cord 754*b* in a manner so as to be non-separable from the first outer cord 754*b* and be restrained from sliding out of the first outer cord 754*b*. According to various embodiments, the length of the first inner cord 754*a* may be the same as the length of the first outer cord 754*b*.

According to various embodiments, the second inner cord 756*a* may be configured to keep or retain, via the inner eyeholes 741*a*, all the double-eyelets-structures 740 of the second row 746 of double-eyelets-structures 740 within bounds or limits as defined by the length of the second inner cord 756*a*. Accordingly, all the double-eyelets-structures 740 of the second row 746 of double-eyelet-structures 740 may be placed or put upon, via the inner eyeholes 741*a*, the second inner cord 756*a* in a manner so as to be non-separable from the second inner cord 756*a* and be restrained from sliding out of the second inner cord 756*a*. According to various embodiments, the second outer cord 756*b* may be configured to keep or retain, via the outer eyeholes 741*b*, all the double-eyelets-structures 740 of the second row 746 of double-eyelets-structures 740 within bounds or limits as defined by the length of the second outer cord 756*b*. Accordingly, all the double-eyelets-structures 740 of the second row 746 of double-eyelet-structures 740 may be placed or put upon, via the outer eyeholes 741*b*, the second outer cord 756*b* in a manner so as to be non-separable from the second outer cord 756*b* and be restrained from sliding out of the second outer cord 756*b*. According to various embodiments, the length of the second inner cord 756*a* may be the same as the length of the second outer cord 756*b*. According to various embodiments all the four cords 754*a*, 754*b*, 756*a*, 756*b* may have the same length.

According to various embodiments, as shown in FIG. 7, each of the four cords 754*a*, 754*b*, 756*a*, 756*b* may include a first cord end 151 fixedly coupled to the rotatable drum 110 and a second cord end 153 having a stopper element 155 which is configured to prevent the second cord end 153 of said cord 754*a*, 754*b*, 756*a*, 756*b* from sliding out of the respective row 744, 746 of double-eyelets-structures 740. According to various embodiments, with the first cord end 151 of each cord 754*a*, 754*b*, 756*a*, 756*b* fixedly coupled to the rotatable drum 110, the rotatable drum 110 may serve as a physical barrier to restrain or restrict or obstruct the double-eyelets-structures 740 from sliding out from the first cord end 151. According to various embodiments, with the stopper element 155 at the second cord end 153 of each cord 754*a*, 754*b*, 756*a*, 756*b*, the stopper element 155 may serve as a physical barrier to restrain or restrict or obstruct the double-eyelets-structures 740 from sliding out from the second cord end 153. According to various embodiments, the stopper element 155 may include, but not limited to, a crimp end, a cord end cap, a knotted end, a bulged end, or an expanded end.

According to various embodiments, not shown, each cord may include a first cord end having a first stopper element which is configured to prevent the first cord end of said cord from sliding out of the respective row of eyelet-structures, and a second cord end having a second stopper element which is configured to prevent the second cord end of said cord from sliding out of the respective row of eyelet-structures. According to various embodiments, with the first stopper element and the second stopper element respectively disposed at the first cord end and the second cord end, respectively, of said cord, the first stopper element at the first cord end may serve as a physical barrier to restrain or restrict or obstruct the eyelet-structures from sliding out from the first cord end and the second stopper element at the second cord end may serve as a physical barrier to restrain or restrict or obstruct the eyelet-structures from sliding out from the second cord end. According to various embodiments, the first stopper element and the second stopper element each may include, but not limited to, a crimp end, a cord end cap, a knotted end, a bulged end, or an expanded end.

According to various embodiments, the first inner cord 754*a*, the first outer cord 754*b*, the second inner cord 756*a* and the second outer cord 756*b* may respectively cooperate with the first row 744 of double-eyelets-structures 740 and the second row 746 of double-eyelets-structures 740 in a manner so as to collectively provide additional securing points and/or holding points for the respective elongate slats such that the respective elongate slats may be retained or held even if the respective elongate slats are broken or fracture from an impact force. According to various embodiments, the first inner cord 754*a*, the first outer cord 754*b*, the second inner cord 756*a* and the second outer cord 756*b* together with the first row 744 of double-eyelets-structures 740 and the second row 746 of double-eyelets-structures 740 may be an assemblage of interacting and/or interdependent features forming a unified whole system for mitigating an impact force.

According to various embodiments, the at least one double-eyelets-structure 740 of each longitudinal end portion 134, 136 of each elongate slat 130 may be protruding in the longitudinal direction of said elongate slat 130. Accordingly, each elongate slat 130 of the series of three or more elongate slats may include at least one double-eyelets-structure 740 protruding from the first longitudinal end portion 134 thereof in a direction of a length of said elongate slat 130 and at least one double-eyelets-structure 740 protruding from the second longitudinal end portion 134 thereof in the direction of the length of said elongate slat 130. According to various embodiments, the at least one double-eyelets-structure 740 of each longitudinal end portion 134, 136 of each elongate slat 130 may be oriented with an axis of respective eyeholes of the at least one double-eyelets-structure 740 of each longitudinal end portion 134, 136 of each elongate slat 130 in a direction parallel to a breadth of said elongate slat 130. Accordingly, the respective axis of the inner and outer eyeholes 741*a*, 741*b* of the at least one double-eyelets-structure 140 of each longitudinal end portion 134, 136 of each elongate slat 130 may be parallel to a perpendicular direction extending between two longitudinal edges of said elongate slat 130.

According to various embodiments, as shown in FIG. 7, each of the elongate slats 130 may include two double-eyelets-structures 740 protruding from each longitudinal end portion 134, 136 of said elongate slat 130. According to various embodiments, the first longitudinal end portion 134 of each elongate slat 130 may include two double-eyelets-structures 740 protruding therefrom, and the second longitudinal end portion 136 of each elongate slat 130 may include two double-eyelets-structures 740 protruding therefrom.

Figure 8A:
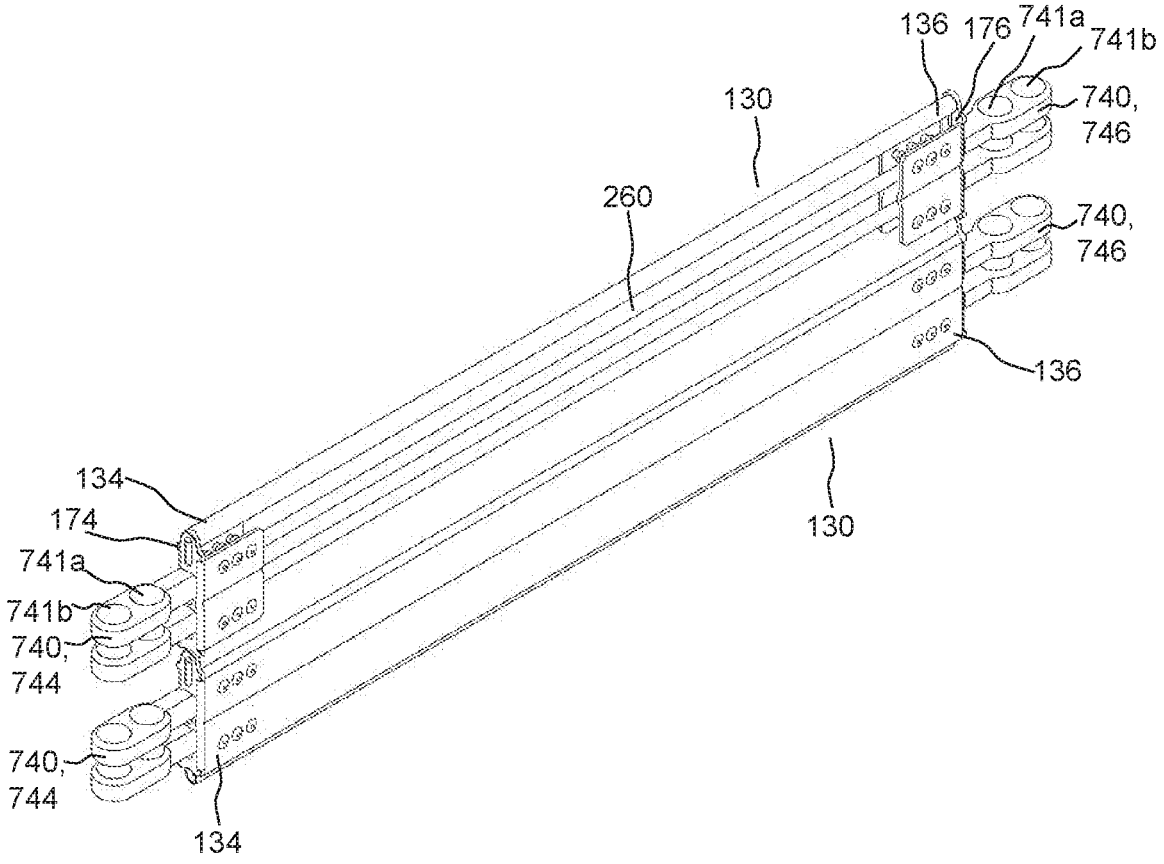
FIG. 8A shows two pivotally interlocked elongate slats of the shutter curtain of the roller shutter of FIG. 7 with a surface of one of the elongate slats cutaway to show an interior of said elongate slat according to various embodiments.
Figure 8B:
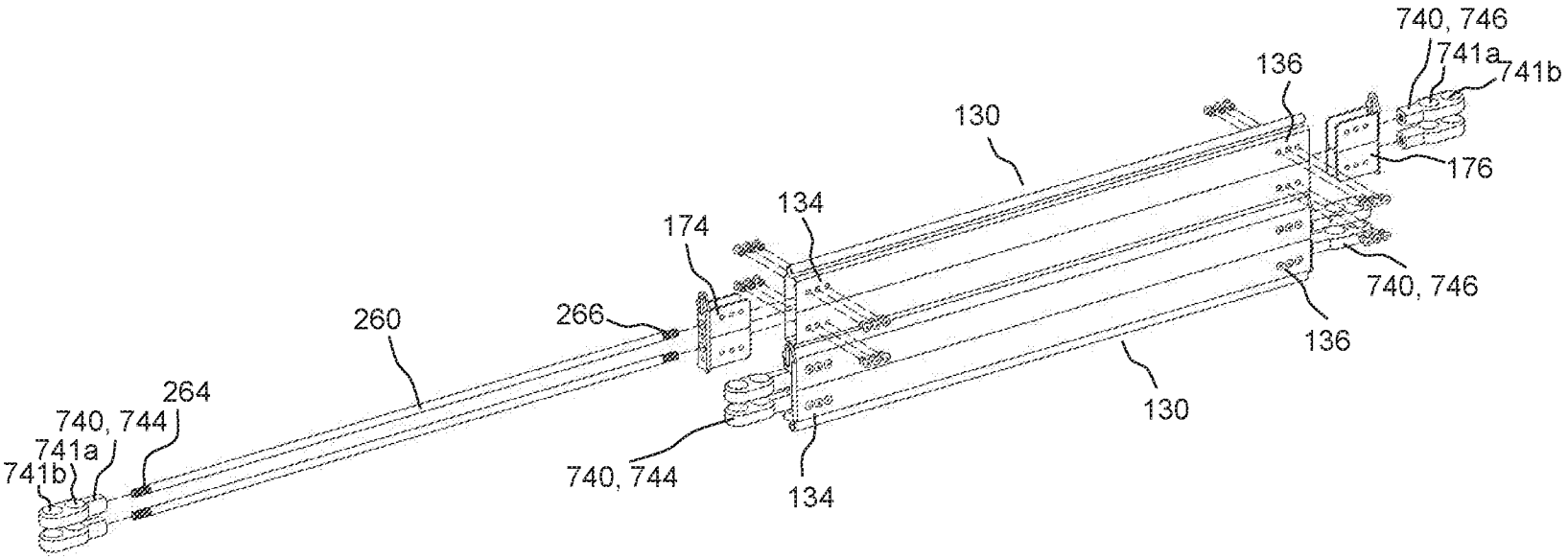
FIG. 8B shows the two pivotally interlocked elongate slats of FIG. 8A with one of the elongate slats in an exploded view according to various embodiments.

FIG. 8A shows two pivotally interlocked elongate slats 130 of the shutter curtain 120 of the roller shutter 700 of FIG. 7 with a surface of one of the elongate slats 130 cutaway to show an interior of said elongate slat 130 according to various embodiments. FIG. 8B shows the two pivotally interlocked elongate slats 130 of FIG. 2A with one of the elongate slats 130 in an exploded view according to various embodiments.

Figure 9A:
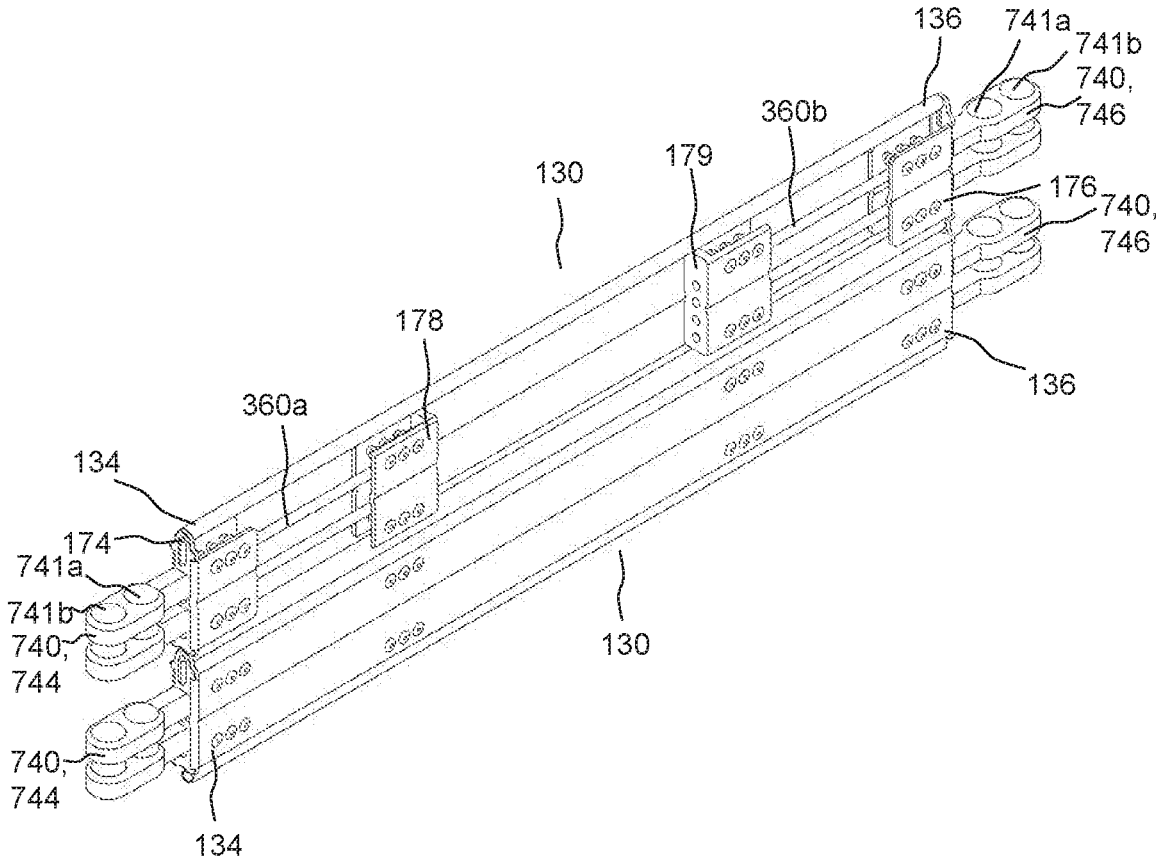
FIG. 9A shows two pivotally interlocked elongate slats of the shutter curtain of the roller shutter of FIG. 7 with a surface of one of the elongate slats cutaway to show a variant of an interior of said elongate slat according to various embodiments.
Figure 9B:
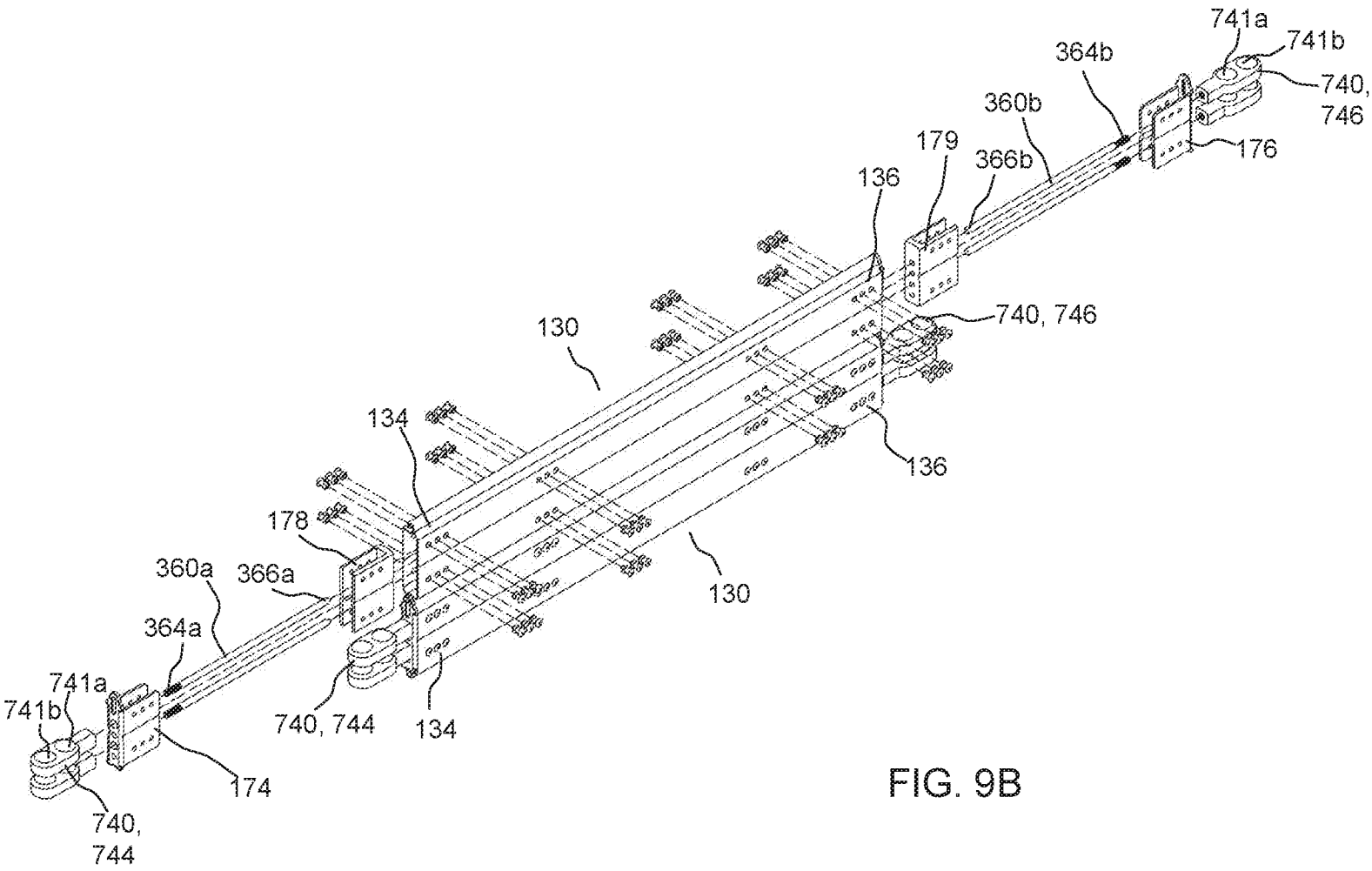
FIG. 9B shows the two pivotally interlocked elongate slats of FIG. 9A with one of the elongate slats in an exploded view according to various embodiments.

According to various embodiments, the roller shutter 700 of FIG. 7 may, similar to the roller shutter 100 of FIG. 1, further include the plurality of elongate reinforcing members 260, 360*a*, 360*b* (see FIG. 9A and FIG. 9B). According to various embodiments, each of the plurality of elongate reinforcing members 260, 360*a*, 360*b* may include, but not limited to, a rod, a pole, a bar, a tube, a wire, a cable, or a cord. According to various embodiments, each of the elongate slats 130 may include at least one elongate reinforcing member 260, 360*a*, 360*b* extending within said elongate slat 130 in a manner so as to be aligned longitudinally to said elongate slat 130. According to various embodiments, the at least one elongate reinforcing member 260, 360*a*, 360*b* of each elongate slat 130 may be secured or coupled to said elongate slat 130 in a manner so as to strengthen or toughen said elongate slat 130. Accordingly, the at least one elongate reinforcing member 260, 360*a*, 360*b* of each elongate slat 130 may serve to support said elongate slat 130 to enhance its resistance against an impact force and/or to mitigate the impact force.

According to various embodiments, as shown in FIG. 8A and FIG. 8B, the at least one elongate reinforcing member 260 of at least one elongate slat 130 may extend across an entire length of said elongate slat 130. Accordingly, the at least one elongate reinforcing member 260 may span across a full length of the at least one elongate slat 130.

According to various embodiments, as shown in FIG. 8A and FIG. 8B, the at least one double-eyelets-structure 740 of each longitudinal end portion 134, 136 of the at least one elongate slat 130 may be integral with the at least one reinforcing member 260 extending within the at least one elongate slat 130. According to various embodiments, the at least one double-eyelets-structure 740 of the first longitudinal end portion 134 of the at least one elongate slat 130 may be integrally connected to the first longitudinal end 264 of the at least one elongate reinforcing member 260 and the at least one double-eyelets-structure 740 of the second longitudinal end portion 136 of the at least one elongate slat 130 may be integrally connected to the second longitudinal end 266 of the at least one elongate reinforcing member 260. Accordingly, the at least one double-eyelets-structure 740 of the first longitudinal end portion 134 of the at least one elongate slat 130, the at least one double-eyelets-structure 740 of the second longitudinal end portion 136 of the at least one elongate slat 130, and the at least one elongate reinforcing member 260 may be integrated or joined in such a way so as to form a single unit which may serve to provide additional securing points and/or holding points for the at least one elongate slat 130 and to strengthen the at least one elongate slat 130 to enhance resistance against an impact force and/or to mitigate the impact force.

According to various embodiments, as shown in FIG. 8A and FIG. 8B, the at least one elongate slat 130 of the roller shutter 700 of FIG. 7 may, similar to the roller shutter 100 of FIG. 1, include a first longitudinal end cover 174 and a second longitudinal end cover 176. According to various embodiments, the first longitudinal end cover 174 may be fixedly coupled to the first longitudinal end portion 134 of the at least one elongate slat 130, and the second longitudinal end cover 176 may be fixedly coupled to the second longitudinal end portion 136 of the at least one elongate slat 130.

According to various embodiments, the at least one reinforcing member 260 may be inserted through the first longitudinal end cover 174 and the second longitudinal end cover 176 so as to be extending within the at least one elongate slat 130. According to various embodiments, the at least one double-eyelets-structure 740 at the first longitudinal end portion 134 of the at least one elongate slat 130 may then be fastened or bond to the first longitudinal end 264 of the at least one elongate reinforcing member 260 and the at least one double-eyelets-structure 740 at the second longitudinal end portion 136 of the at least one elongate slat 130 may then be fastened or bond to the second longitudinal end 266 of the at least one elongate reinforcing member 260. Accordingly, in this manner, the first longitudinal end 264 of the at least one elongate reinforcing member 260 may be joined to the at least one double-eyelets-structure 740 at the first longitudinal end portion 134 of the at least one elongate slat 130 with the at least one double-eyelets-structure 740 outside the first longitudinal end cover 174, and the second longitudinal end 266 of the at least one elongate reinforcing member 260 may be joined to the at least one double-eyelets-structure 740 at the second longitudinal end portion 136 of the at least one elongate slat 130 with the at least one double-eyelets-structure 740 outside the second longitudinal end cover 176.

According to various embodiments, as shown in FIG. 8A and FIG. 8B, the at least one elongate reinforcing member 260 of the at least one elongate slat 130 may include two identical elongate reinforcing member 260, each may extend across an entire length of said elongate slat 130. According to various embodiments, the two identical elongate reinforcing member 260 may be joined to the at least one elongate slat 130 in the same manner.

FIG. 9A shows two pivotally interlocked elongate slats 130 of the shutter curtain 120 of the roller shutter 700 of FIG. 7 with a surface of one of the elongate slats 130 cutaway to show a variant of an interior of said elongate slat 130 according to various embodiments. FIG. 9B shows the two pivotally interlocked elongate slats 130 of FIG. 9A with one of the elongate slats 130 in an exploded view according to various embodiments.

According to various embodiments, as shown in FIG. 9A and FIG. 9B, the at least one elongate slat 130 may include a first elongate reinforcing member 360*a* and a second elongate reinforcing member 360*b*. According to various embodiments, the first elongate reinforcing member 360*a* may extend longitudinally inwards from the first longitudinal end portion 134 of the at least one elongate slat 130 and the second elongate reinforcing member 360*b* may extend longitudinally inwards from the second longitudinal end portion 136 of the at least one elongate slat 130. According to various embodiments, the first elongate reinforcing member 360*a* may extend longitudinally inwards for more than a tenth of a length, or a fifth of a length, or a quarter of a length of the at least one elongate slat 130 and the second elongate reinforcing member 360*b* may extend longitudinally inwards for more than a tenth of a length, or a fifth of a length, or a quarter of a length of the at least one elongate slat 130.

According to various embodiments, as shown in FIG. 9A and FIG. 9B, the at least one double-eyelets-structure 740 of the first longitudinal end portion 134 of the at least one elongate slat 130 may be integral with the first elongate reinforcing member 360*a*, and the at least one double-eyelets-structure 740 of the second longitudinal end portion 136 of the at least one elongate slat 130 may be integral with the second elongate reinforcing member 360*b*. According to various embodiments, the at least one double-eyelets-structure 740 of the first longitudinal end portion 134 of the at least one elongate slat 130 may be integrally connected to the first longitudinal end 364*a* of the first elongate reinforcing member 360*a* and the at least one double-eyelets-structure 740 of the second longitudinal end portion 136 of the at least one elongate slat 130 may be integrally connected to the first longitudinal end 364*b* of the second elongate reinforcing member 360*b*. Accordingly, the at least one double-eyelets-structure 140 of the first longitudinal end portion 134 of the at least one elongate slat 130 and the first elongate reinforcing member 360*a* may be integrated or joined in such a way as to form a first single unit, and the at least one double-eyelets-structure 740 of the second longitudinal end portion 136 of the at least one elongate slat 130 and the second elongate reinforcing member 360*b* may be integrated or joined in such a way as to form a second single unit. According to various embodiments, the first single unit and the second single unit may cooperatively serve to provide additional securing points and/or holding points for the at least one elongate slat 130 and to strengthen the at least one elongate slat 130 to enhance resistance against an impact force and/or to mitigate the impact force.

According to various embodiments, as shown in FIG. 9A and FIG. 9B, the at least one elongate slat 130 may include a first longitudinal end cover 174 and a second longitudinal end cover 176. Further, the at least one elongate slat 130 may include a first intermediate bracket 178 and a second intermediate bracket 179. According to various embodiments, the first longitudinal end cover 174 may be fixedly coupled to the first longitudinal end portion 134 of the at least one elongate slat 130, and the second longitudinal end cover 176 may be fixedly coupled to the second longitudinal end portion 136 of the at least one elongate slat 130. According to various embodiments, the first intermediate bracket 178 and the second intermediate bracket 179 each may be inserted inside the at least one elongate slat 130 and may be fixedly coupled to a predetermined position inside the at least one elongate slat 130. According to various embodiments, the first intermediate bracket 178 may be positioned at a predetermined distance from the first longitudinal end cover 174 and the second intermediate bracket 179 may be positioned at a predetermined distance from the second longitudinal end cover 176.

According to various embodiments, the first reinforcing member 360*a* may be inserted through the first longitudinal end cover 174 so as to be extending longitudinally inwards from the first longitudinal end portion 134 of the at least one elongate slat 130. According to various embodiments, the second reinforcing member 360*b* may be inserted through the second longitudinal end cover 176 so as to be extending longitudinally inwards from the second longitudinal end portion 136 of the at least one elongate slat 130. According to various embodiments, the at least one double-eyelets-structure 740 at the first longitudinal end portion 134 of the at least one elongate slat 130 may then be fastened or bond to the first longitudinal end 364*a* of the first elongate reinforcing member 360*a* and the at least one double-eyelets-structure 740 at the second longitudinal end portion 136 of the at least one elongate slat 130 may then be fastened or bond to the first longitudinal end 364*b* of the second elongate reinforcing member 360*b*. According to various embodiments, the second longitudinal end 366*a* of the first elongate reinforcing member 360*a* may be fastened or bonded to the first intermediate bracket 178, and the second longitudinal end 366*b* of the second elongate reinforcing member 360*b* may be fastened or bonded to the second intermediate bracket 179. Accordingly, in this manner, the first elongate reinforcing member 360*a* may be joined to the at least one elongate slat 130 via the first longitudinal end cover 174, the at least one double-eyelets-structure 740 at the first longitudinal end portion 134, and the first intermediate bracket 178. Further, the second elongate reinforcing member 360*b* may be joined to the at least one elongate slat 130 via the second longitudinal end cover 176, the at least one double-eyelets-structure 740 at the second longitudinal end portion 136, and the second intermediate bracket 179.

According to various embodiments, as shown in FIG. 9A and FIG. 9B, the at least one elongate slat 130 may include two identical pairs of the first and second elongate reinforcing members 360*a*, 360*b*. According to various embodiments, the two identical pairs of the first and second elongate reinforcing members 360*a*, 360*b* may be joined to the at least one elongate slat 130 in the same manner.

According to various embodiments, each of the elongate slats 130 of the shutter curtain 120 of the roller shutter 700 of FIG. 7 may include the at least one elongate reinforcing member 260 of FIG. 8A and FIG. 8B which extends across an entire length of said elongate slat 130. According to various embodiments, each of the elongate slats 130 of the shutter curtain 120 of the roller shutter 700 of FIG. 7 may include the first and second elongate reinforcing members 360*a*, 360*b* of FIG. 9A and FIG. 9B. According to various embodiments, the series of three of more elongate slats 130 of the shutter curtain 120 of the roller shutter 700 may include at least one elongate slat 130 having the at least one elongate reinforcing member 260 of FIG. 8A and FIG. 8B which extends across an entire length of said elongate slat 130 and at least one elongate slat 130 having the first and the second elongate reinforcing members 360*a*, 360*b* of FIG. 9A and FIG. 9B.

Figure 10B:
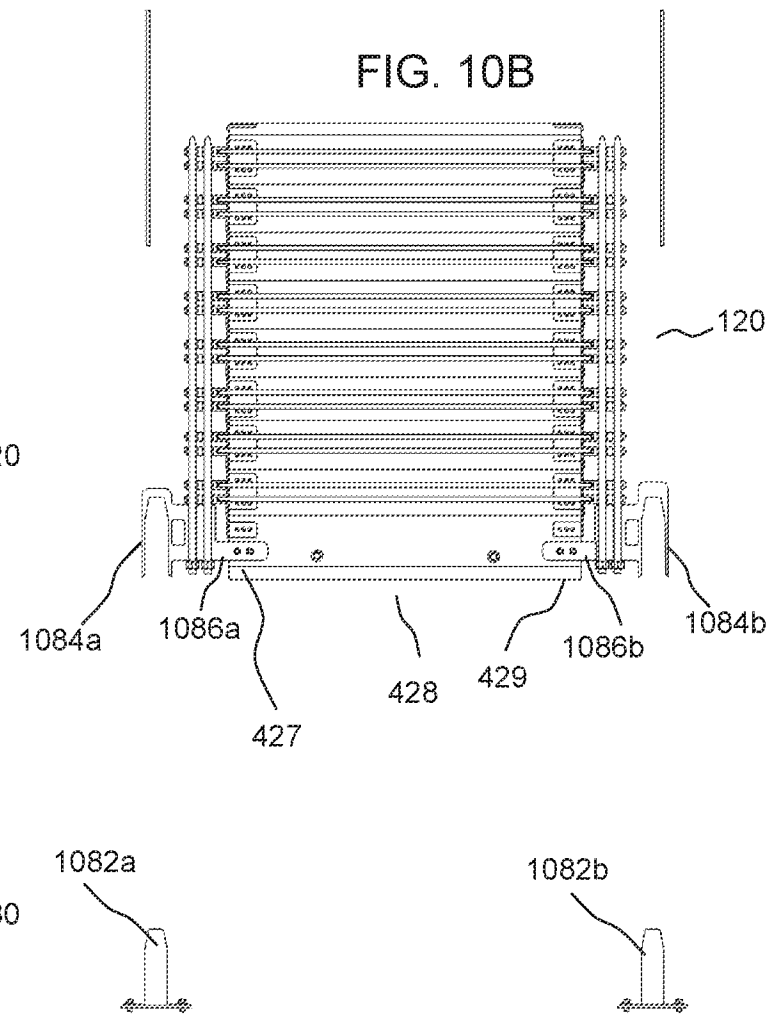
FIG. 10B shows a cross sectional view of the shutter curtain of the roller shutter of FIG. 7 when the shutter curtain is partially lowered according to various embodiments.
Figure 10A:
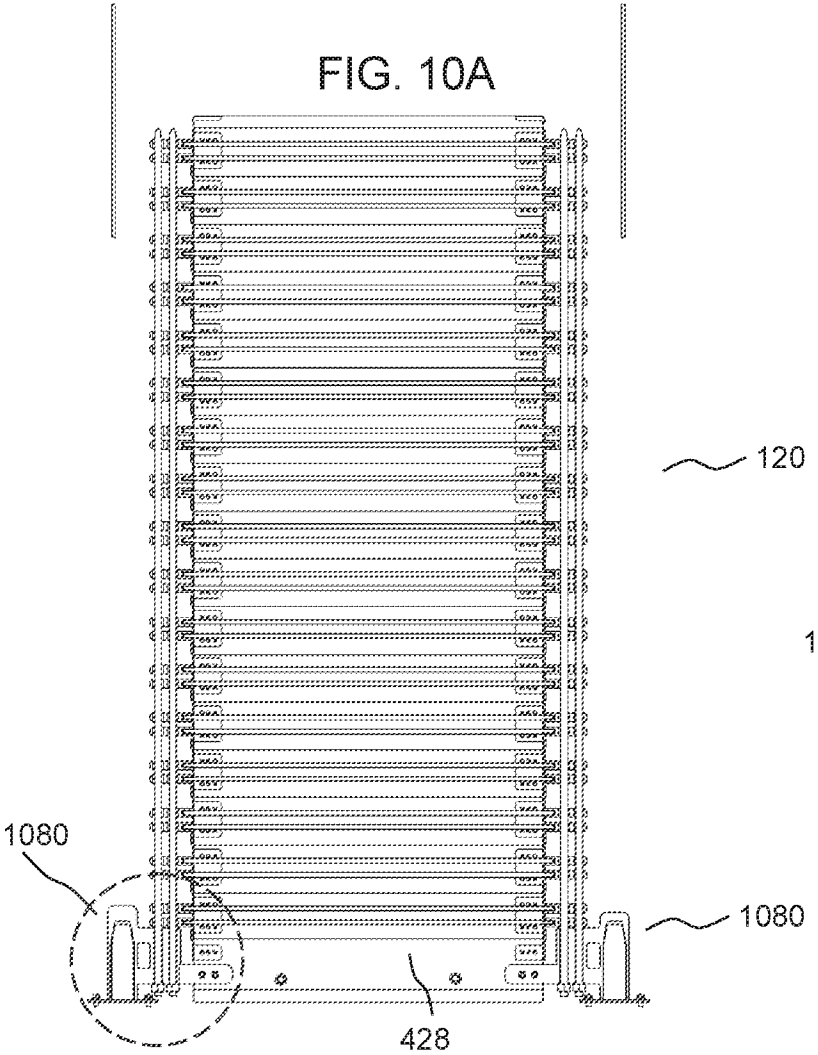
FIG. 10A shows a cross sectional view of the shutter curtain of the roller shutter of FIG. 7 when the shutter curtain is fully lowered according to various embodiments.
Figure 10C:
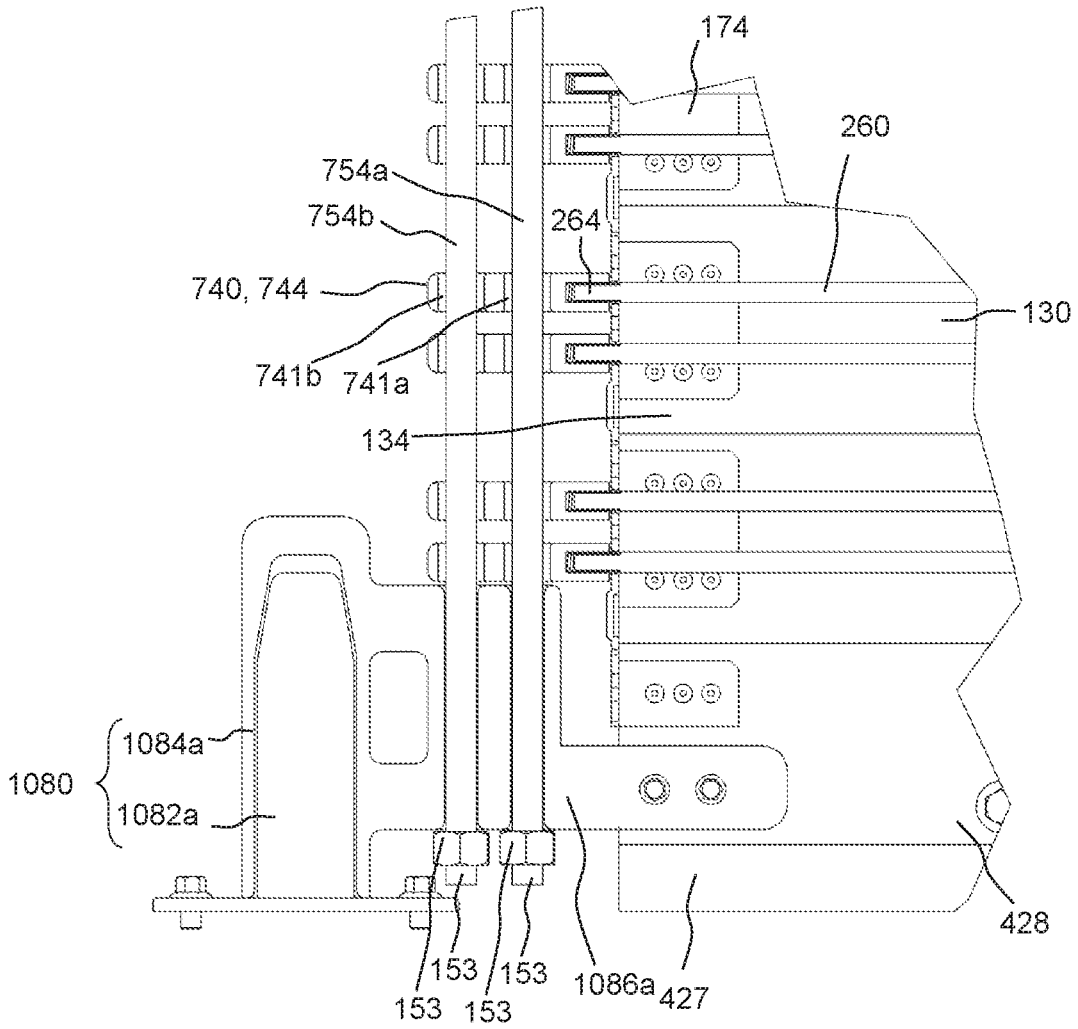
FIG. 10C shows an enlarged view of the circled portion in FIG. 10A illustrating an retaining arrangement according to various embodiments.

FIG. 10A shows a cross sectional view of the shutter curtain 120 of the roller shutter 700 of FIG. 7 when the shutter curtain 120 is fully lowered according to various embodiments. FIG. 10B shows a cross sectional view of the shutter curtain 120 of the roller shutter 700 of FIG. 7 when the shutter curtain 120 is partially lowered according to various embodiments. FIG. 10C shows an enlarged view of the circled portion in FIG. 10A illustrating a retaining arrangement 1080 (or a retaining-and-alignment arrangement) of the roller shutter 700 of FIG. 7 according to various embodiments.

According to various embodiments, the roller shutter 700 may, similar to the roller shutter 100 of FIG. 1, further include the retaining arrangement 1080 (or the retaining-and-alignment arrangement) configured to align a bottom rail 428 of the shutter curtain 120 to a predetermined position on a ground and to retain or restrain the bottom rail 428 from sideways or lateral movements in said position when the shutter curtain 120 is lowered. According to various embodiments, the retaining arrangement 1080 may be configured such that the bottom rail 428 of the shutter curtain 120 may be brought into alignment with the predetermined position on the ground as the shutter curtain 120 is being lowered. Further, the retaining arrangement 1080 may be configured such that the bottom rail 428 may not be easily moved out of alignment (or moved sideways or moved laterally) or may be held in place with respect to horizontal movement once the shutter curtain 120 is fully lowered. Accordingly, the retaining arrangement 1080 may be configured for laterally retaining the bottom rail 428 against sideways, or horizontal, or lateral movements.

According to various embodiments, the retaining arrangement 1080 may include two bollards 1082*a*, 1082*b* fixed to the ground and two corresponding caps 1084*a*, 1084*b* attached to the bottom rail 428 of the shutter curtain 120. According to various embodiments, as the two corresponding caps 1084*a*, 1084*b* fit over the two bollards 1082*a*, 1082*b* when the shutter curtain 120 is lowering, the bottom rail 428 of the shutter curtain 120 may be adjusted according to a straight line joining the two bollards 1082*a*, 1082*b*. According to various embodiments, each of the two bollards 1082*a*, 1082*b* may include, but not limited to, a conical bollard or a frusto-conical bollard. According to various embodiments, each of the two bollards 1082*a*, 1082*b* may have a height higher than a height of the bottom rail 428 of the shutter curtain 120. According to various embodiments, each of the two corresponding caps 1084*a*, 1084*b* may include a cavity with a shape that correspond to the shape of the bollard 1082*a*, 1082*b* which the corresponding cap 1084*a*, 1084*b* is to be fitted on. According to various embodiments, the two bollards 1082*a*, 1082*b* may be fixed to the ground in a spaced apart manner such that, when the shutter curtain is lowered, a first bollard 1082*a* may be adjacent a first longitudinal end 427 of the bottom rail 428 of the shutter curtain 120 and a second bollard 1082*b* may be adjacent to a second longitudinal end 429 of the bottom rail 428 of the shutter curtain 120. Accordingly, the first cap 1084*a* may be attached, via a first connecting portion 1086*a*, to the first longitudinal end 427 of the bottom rail 428 of the shutter curtain 120 and the second cap 1084*b* may be attached, via a second connecting portion 1086*b*, to the second longitudinal end 429 of the bottom rail 428 of the shutter curtain 120.

According to various embodiments, the second cord end 153 of the respective first inner cord 754*a* and first outer cord 754*b* may be threaded through the first connecting portion 1086*a*. According to various embodiments, the second cord end 153 of the respective second inner cord 756*a* and second outer cord 756*b* may be threaded through the second connecting portion 1086*b*. According to various embodiments, the stopper element 155 of the second cord end 153 of the respective cords 754*a*, 754*b*, 756*a*, 756*b* may be configured to retain or confine the respective first and second connecting portions 1086*a*, 1086*b* within the length of the respective cords 754*a*, 754*b*, 756*a*, 756*b*. According to various embodiments, the stopper element 155 of the second cord end 153 of the respective cords 754*a*, 754*b*, 756*a*, 756*b* may serve as a physical barrier to restrain or restrict or obstruct the respective first and second connecting portions 1086*a*, 1086*b* from sliding out from the second cord end 153 of the respective cords 754*a*, 754*b*, 756*a*, 756*b*. With the second cord end 153 of the respective cords 754*a*, 754*b*, 756*a*, 756*b* being coupled to the bottom rail 428 and the first and second cap 1084*a*, 1084*b* via the respective first and second connecting portion 1086*a*, 1086*b*, the second cord end 153 of the respective cords 754*a*, 754*b*, 756*a*, 756*b* may be restrained by the retaining arrangement 480 from sideways or lateral movements due to the bottom rail 428 being restrained or retained by the retaining arrangement 1080 when the shutter curtain 120 is lowered. According to various embodiments, with the four cords 754*a*, 754*b*, 756*a*, 756*b* extending from the rotatable drum 110 to the bottom rail 428, all the slats 130 of the shutter curtain 120 (including the bottom rail 428) may be confined within the length of the respective cords 754*a*, 754*b*, 756*a*, 756*b*. Accordingly, when the shutter curtain 120 is lowered, the shutter curtain 120 may weigh down the second cord end 153 of the respective cords 754*a*, 754*b*, 756*a*, 756*b* to the ground. Hence, the respective cords 754*a*, 754*b*, 756*a*, 756*b* may be extending from the rotatable drum 110 to the ground such that the respective cords 754*a*, 754*b*, 756*a*, 756*b* may provide additional support to the shutter curtain 120 in a manner so as to mitigate impact force applied on the shutter curtain 120.

Figure 11:
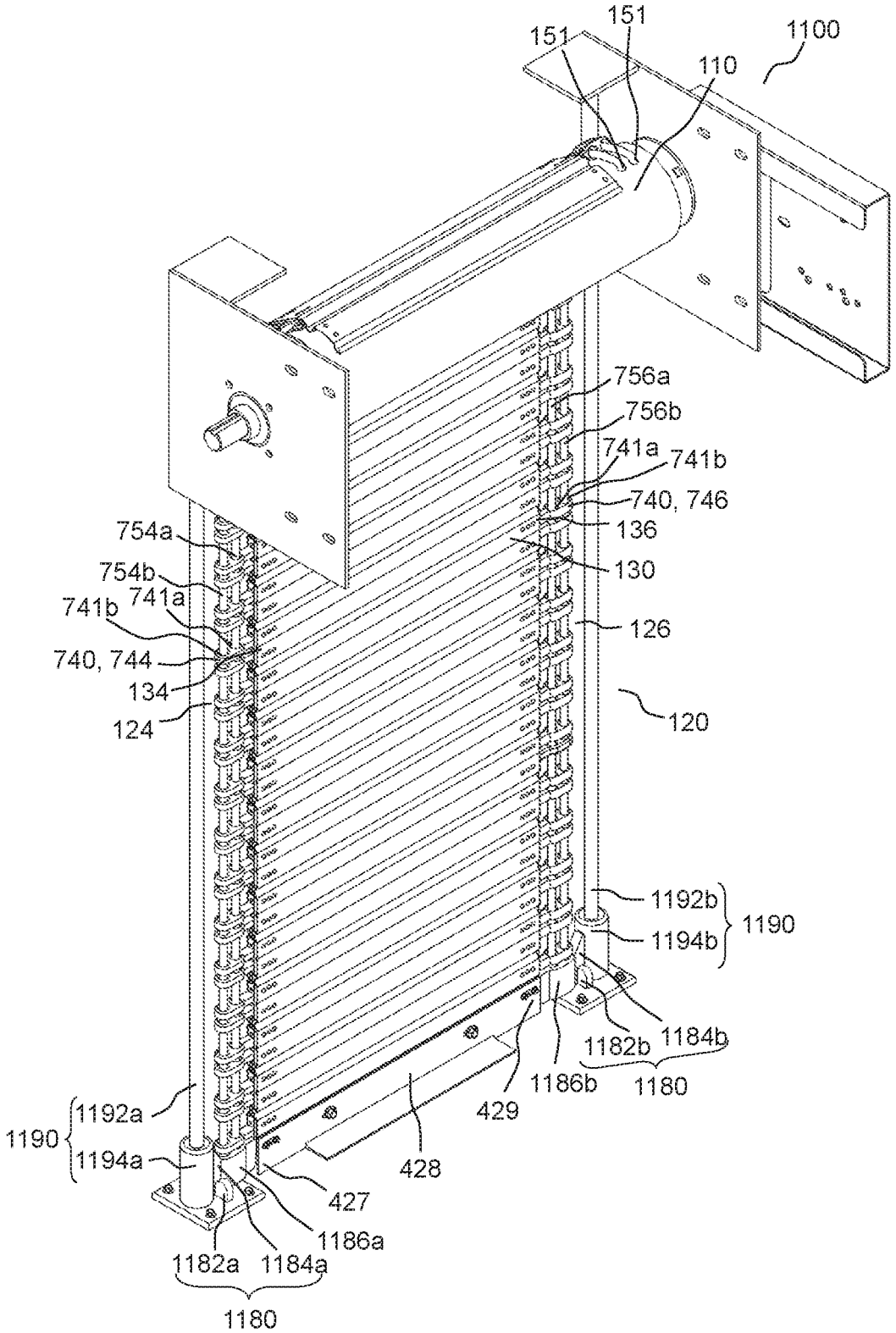
FIG. 11 shows a roller shutter according to various embodiments.
Figure 12B:
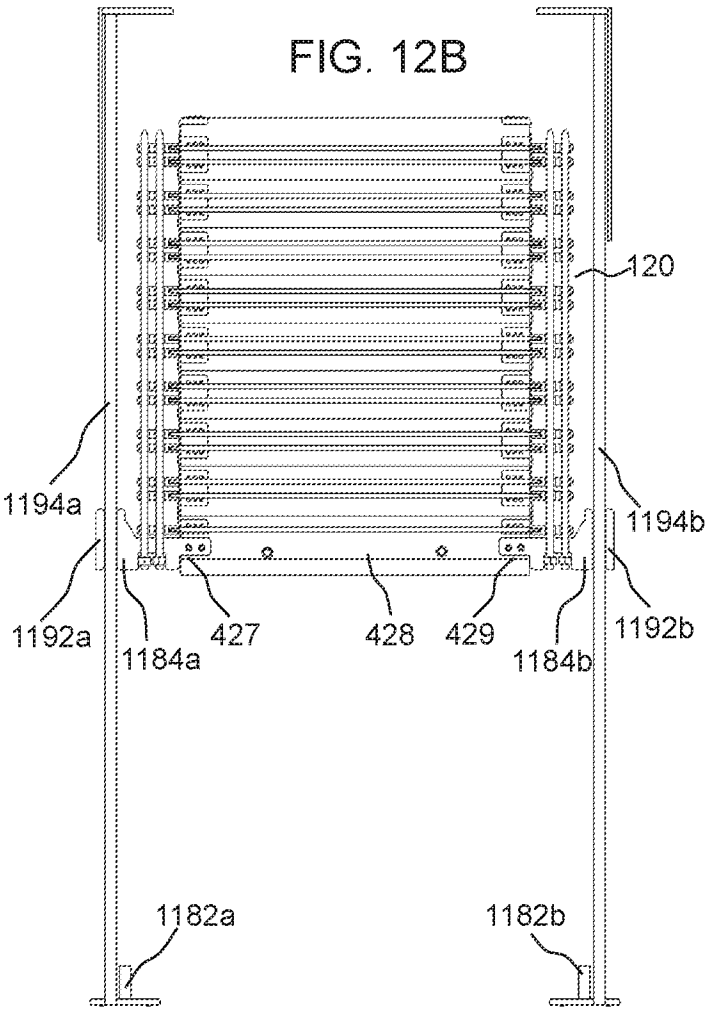
FIG. 12B shows a shows a cross sectional view of the shutter curtain of the roller shutter of FIG. 12A when the shutter curtain is partially lowered according to various embodiments.
Figure 12A:
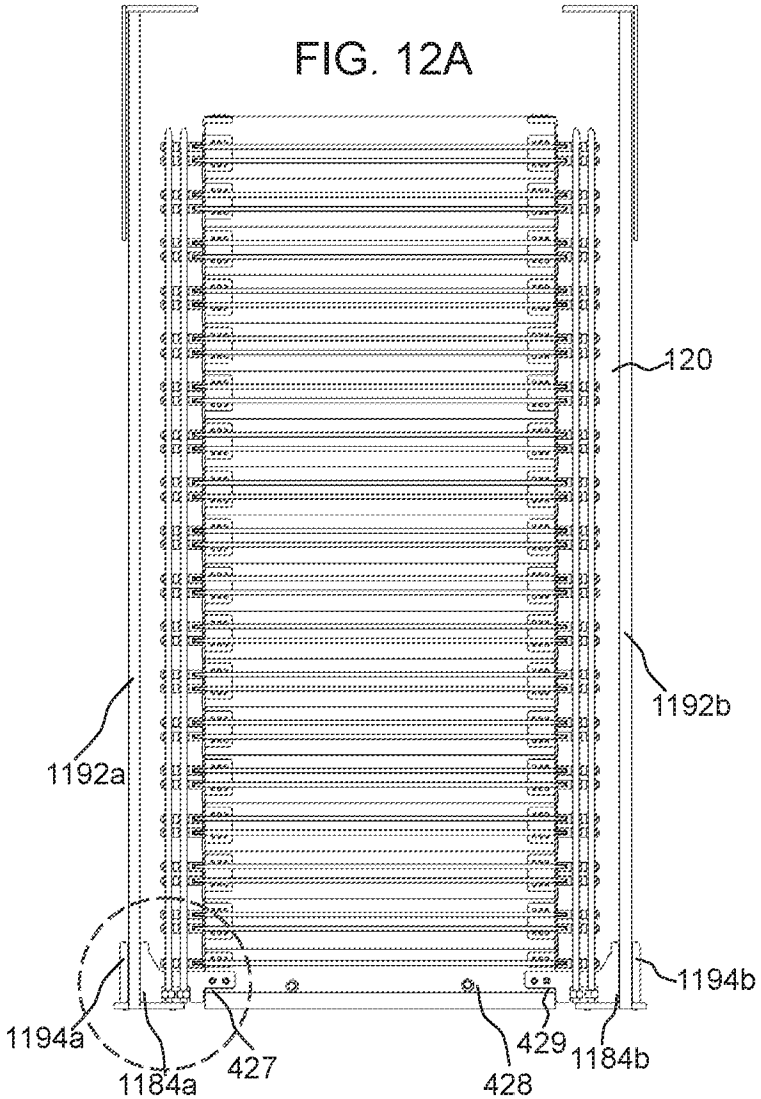
FIG. 12A shows a cross sectional view of the shutter curtain of the roller shutter of FIG. 11 when the shutter curtain is fully lowered according to various embodiments.
Figure 12C:
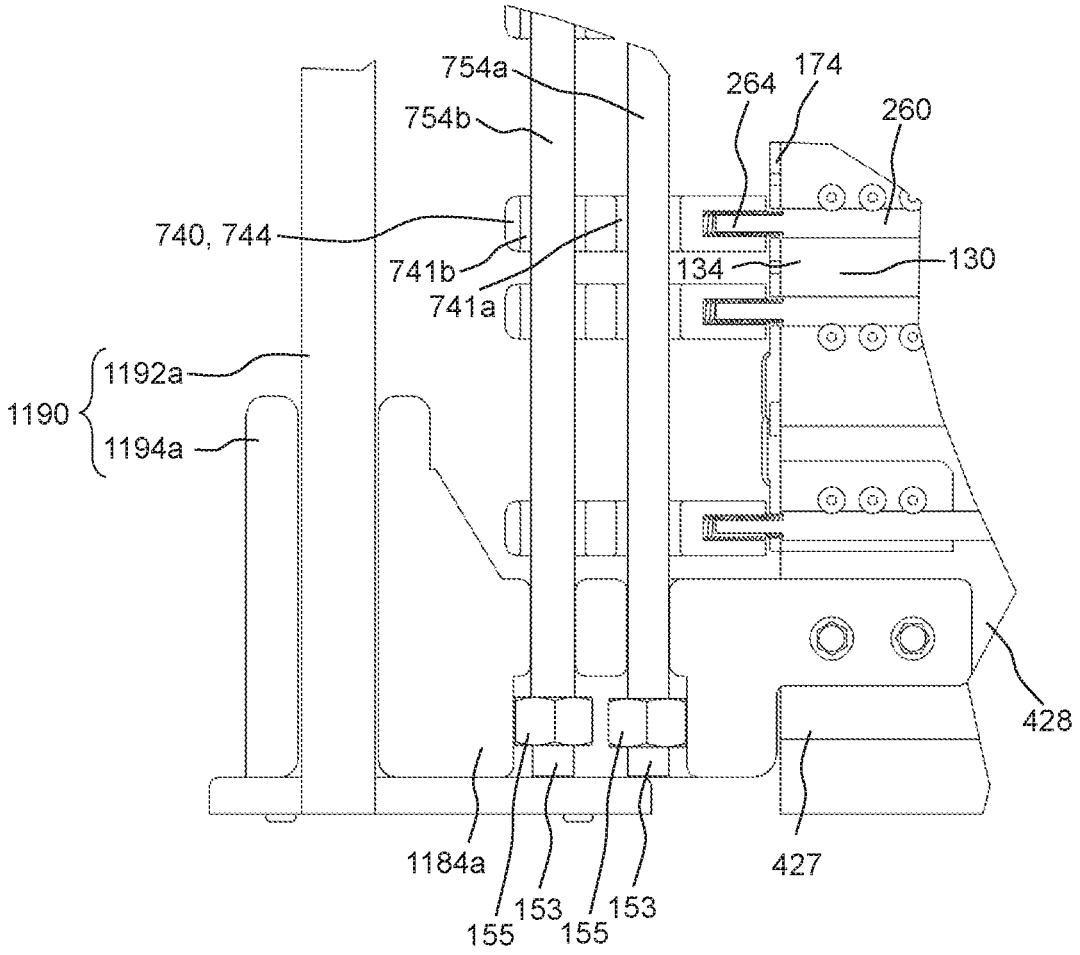
FIG. 12C shows an enlarged view of the circled portion in FIG. 12A illustrating a retaining arrangement according to various embodiments.

FIG. 11 shows a roller shutter 1100 according to various embodiments. FIG. 12A shows a cross sectional view of the shutter curtain 120 of the roller shutter 1100 of FIG. 11 when the shutter curtain 120 is fully lowered according to various embodiments. FIG. 12B shows a shows a cross sectional view of the shutter curtain 120 of the roller shutter 1100 of FIG. 12A when the shutter curtain 120 is partially lowered according to various embodiments. FIG. 12C shows an enlarged view of the circled portion in FIG. 12A illustrating a retaining arrangement 1180 according to various embodiments. According to various embodiments, the roller shutter 1100 of FIG. 11 may, similar to the roller shutter 100 of FIG. 1, the roller shutter 500 of FIG. 5, and the roller shutter 700 of FIG. 7, be configured for mitigating an impact force applied to the roller shutter 1100. According to various embodiments, the roller shutter 1100 of FIG. 11 may be similar to the roller shutter 700 of FIG. 7 in all aspect, except that the roller shutter 1100 of FIG. 11 may include the retaining arrangement 1180 (or the retaining-and-alignment arrangement) which is different from the retaining arrangement 1080 of the roller shutter 700 as shown in FIG. 10A to FIG. 10C and that the roller shutter 1100 of FIG. 11 may further include a sliding guide arrangement 1190. According to various embodiments, the roller shutter 1100 of FIG. 11 may, similar to the roller shutter 700 of FIG. 7, include, inter alia, the rotatable drum 110; the shutter curtain 120 having the series of three or more elongate slats 130; the first row 744 of double-eyelets-structures 740 and the second row 746 of double-eyelets-structures 740 formed along the first and second side borders 124, 126, respectively, of the shutter curtain 120; the at least one elongate reinforcing member 260, 360*a*, 360*b* extending within each elongate slat 130; and the first longitudinal end cover 174 and the second longitudinal end cover 176 coupled to each elongate slat 130.

According to various embodiments, the roller shutter 1100 may include the retaining arrangement 1180 (or the retaining-and-alignment arrangement). According to various embodiments, the retaining arrangement 1180 may, similar to the retaining arrangement 1080 of FIG. 10A to FIG. 10C, be configured to align a bottom rail 428 of the shutter curtain 120 to a predetermined position on a ground and to retain or restrain the bottom rail 428 from sideways or lateral movements in said position when the shutter curtain 120 is lowered. According to various embodiments, the retaining arrangement 1180 may, similar to the retaining arrangement 1080 of FIG. 10A to FIG. 10C, be configured such that the bottom rail 428 of the shutter curtain 120 may be brought into alignment with the predetermined position on the ground as the shutter curtain 120 is being lowered. Further, the retaining arrangement 1180 may, similar to the retaining arrangement 1080 of FIG. 10A to FIG. 10C, be configured such that the bottom rail 428 may not be easily moved out of alignment (or moved sideways or moved laterally) once the shutter curtain 120 is fully lowered. Accordingly, the retaining arrangement 1180 may be configured for laterally retaining the bottom rail 428 against sideways, or horizontal, or lateral movements.

According to various embodiments, the alignment arrangement 1180 may differ from the alignment arrangement 1080 of FIG. 10A to FIG. 10C, in that the retaining arrangement 1180 may include two brackets 1182*a*, 1182*b*, each bracket 1182*a*, 1182*b* having a Y-shaped slot, fixed to the ground and two corresponding insert members 1184*a*, 1184*b* attached to the bottom rail 428 of the shutter curtain 120. According to various embodiments, as the two corresponding insert members 1184*a*, 1184*b* fit into the two brackets 1182*a*, 1182*b* when the shutter curtain 120 is lowering, the bottom rail 428 of the shutter curtain 120 may be adjusted according to a straight line joining the two brackets 1182*a*, 1182*b*. According to various embodiments, the two brackets 1182*a*, 1182*b* may be fixed to the ground in a spaced apart manner such that, when the shutter curtain 120 is lowered, a first bracket 1182*a* may be adjacent a first longitudinal end 427 of the bottom rail 428 of the shutter curtain 120 and a second bracket 1182*b* may be adjacent to a second longitudinal end 429 of the bottom rail 428 of the shutter curtain 120. Accordingly, a first insert members 1184*a* may be attached, via a first connecting portion 1186*a*, to the first longitudinal end 427 of the bottom rail 428 of the shutter curtain 120 and a second insert member 1184*b* may be attached, via a second connecting portion 1186*b*, to the second longitudinal end 429 of the bottom rail 428 of the shutter curtain 120.

According to various embodiments, the second cord end 153 of the respective first inner cord 754*a* and first outer cord 754*b* may be threaded through the first connecting portion 1186*a*. According to various embodiments, the second cord end 153 of the respective second inner cord 756*a* and second outer cord 756*b* may be threaded through the second connecting portion 1186*b*. According to various embodiments, the stopper element 155 of the second cord end 153 of the respective cords 754*a*, 754*b*, 756*a*, 756*b* may be configured to retain or confine the respective first and second connecting portions 1186*a*, 1186*b* within the length of the respective cords 754*a*, 754*b*, 756*a*, 756*b*. According to various embodiments, the stopper element 155 of the second cord end 153 of the respective cords 754*a*, 754*b*, 756*a*, 756*b* may serve as a physical barrier to restrain or restrict or obstruct the respective first and second connecting portions 1186*a*, 1186*b* from sliding out from the second cord end 153 of the respective cords 754*a*, 754*b*, 756*a*, 756*b*. With the second cord end 153 of the respective cords 754*a*, 754*b*, 756*a*, 756*b* being coupled to the bottom rail 428 and the first and second insert members 1184*a*, 1184*b* via the respective first and second connecting portion 1186*a*, 1186*b*, the second cord end 153 of the respective cords 754*a*, 754*b*, 756*a*, 756*b* may be restrained by the retaining arrangement 1180 from sideways or lateral movements due to the bottom rail 428 being restrained or retained by the retaining arrangement 1180 when the shutter curtain 120 is lowered. According to various embodiments, with the four cords 754*a*, 754*b*, 756*a*, 756*b* extending from the rotatable drum 110 to the bottom rail 428, all the slats 130 of the shutter curtain 120 (including the bottom rail 428) may be confined within the length of the respective cords 754*a*, 754*b*, 756*a*, 756*b*. Accordingly, when the shutter curtain 120 is lowered, the shutter curtain 120 may weigh down the second cord end 153 of the respective cords 754*a*, 754*b*, 756*a*, 756*b* to the ground. Hence, the respective cords 754*a*, 754*b*, 756*a*, 756*b* may be extending from the rotatable drum 110 to the ground such that the respective cords 754*a*, 754*b*, 756*a*, 756*b* may provide additional support to the shutter curtain 120 in a manner so as to mitigate impact force applied on the shutter curtain 120.

According to various embodiments, the roller shutter 1100 may further include a sliding guide arrangement 1190 which may include a first guiding rod 1192*a* and a second guiding rod 1192*b* fixed to the ground in an upright orientation and spaced apart in a manner so as to be respectively disposed adjacent the first and second side borders 124, 126, respectively, of the shutter curtain 120 when the shutter curtain 120 is lowered. Accordingly, the first guiding rod 1192*a* and the second guiding rod 1192*b* may be erected from the ground upwards and set apart from each other by a distance equivalent or close to a width of the shutter curtain 120 measured from the first side border 124 to the second side border 126. According to various embodiments, the sliding guide arrangement 1190 may further include a first sliding element 1194*a* and a second sliding element 1194*b* attached to the first longitudinal end 427 and the second longitudinal end 429, respectively, of the bottom rail 428 of the shutter curtain 120. Accordingly, the first sliding element 1194*a* may be protruding from the first longitudinal end 427 of the bottom rail 428 of the shutter curtain 120 and the second sliding element 1194*b* may be protruding from the second longitudinal end 429 of the bottom rail 428 of the shutter curtain 120. According to various embodiments, the first sliding element 1194*a* may attached to the first longitudinal end 427 of the bottom rail 428 via the first insert member 1184*a* and the first connecting portion 1186*a*, and the second sliding element 1194*b* may be attached to the second longitudinal end 429 of the bottom rail 428 via the second insert member 1184*b* and the second connecting portion 1186*b*. According to various embodiments, the first sliding element 1194*a* may be in engagement with the first guiding rod 1192*a* and the second sliding element 1194*b* is in engagement with the second guiding rod 1192*b*. According to various embodiments, each of the first and second sliding elements 1194*a*, 1194*b* may be of a hollow cylindrical shape having a central through-hole whereby the first guiding rod 1192*a* is passed through the central through-hole of the first sliding element 1194*a* and the second guiding rod 1192*b* is passed through the central through-hole of the second sliding element 1194*b* such that each of the first and second sliding elements 1194*a*, 1194*b* may slide along respective first and second guiding rod 1192*a*, 1192*b*.

While the various embodiments as described and as shown in the drawings include eyelet-structure with either one eyehole (single-eyelet-structure) or two eyehole (i.e. double-eyelets-structure), it is understood that the eyelet-structure of the roller shutter according to various embodiments may include any number of eyeholes, for example one eyehole or two eyeholes or three eyeholes or more. Accordingly, the roller shutter may also include a corresponding number of cords for threading through the respective number of eyeholes in the manner as described earlier.

The following examples pertain to various embodiments.

Example 1 is a roller shutter including:

a rotatable drum having a rotational axis;

a shutter curtain including a series of three or more elongate slats pivotally interlocked in a longitudinal-edge-to-longitudinal-edge arrangement one after another and arranged parallel to the rotational axis of the rotatable drum in a manner so as to be capable of being wound on and off the rotatable drum together in an interlocked state, each of the elongate slats having a first longitudinal end portion and a second longitudinal end portion, wherein the first and second longitudinal end portions being respectively aligned to form a first side border and a second side border, respectively, of the shutter curtain, and wherein the first longitudinal end portion and the second longitudinal end portion of each elongate slat are respectively provided with at least one eyelet-structure which protrudes therefrom, whereby a first row of eyelet-structures and a second row of eyelet-structures are formed along the first and second side borders, respectively, of the shutter curtain; and at least a first cord and a second cord, the first cord being strung loosely through all eyelet-structures of the first row of eyelet-structures and the second cord being strung loosely through all eyelet-structures of the second row of eyelet-structures, and each cord being configured to confine all eyelet-structures of respective row of eyelet-structures within a length of each cord.

In Example 2, the subject matter of Example 1 may optionally include that each cord may include a first cord end fixedly coupled to the rotatable drum and a second cord end having a stopper element which is configured to prevent the second cord end of said cord from sliding out of the respective row of eyelet-structures.

In Example 3, the subject matter of Example 1 may optionally include that each cord may include a first cord end having a first stopper element which may be configured to prevent the first cord end of said cord from sliding out of the respective row of eyelet-structures, and a second cord end having a second stopper element which may be configured to prevent the second cord end of said cord from sliding out of the respective row of eyelet-structures.

In Example 4, the subject matter of Example 2 or Example 3 may optionally include that respective stopper element may include a crimp end, a cord end cap, a knotted end, a bulged end, or an expanded end.

In Example 5, the subject matter of any one of Examples 1 to 4 may optionally include that the at least one eyelet-structure of each longitudinal end portion of each elongate slat may be protruding in a longitudinal direction of said elongate slat, and wherein the at least one eyelet-structure may be oriented with an axis of a hole of the at least one eyelet-structure of each longitudinal end portion of each elongate slat in a direction parallel to a breadth of said elongate slat.

In Example 6, the subject matter of any one of Examples 1 to 5 may optionally include that each of the elongate slats may include two eyelet-structures protruding from each longitudinal end portion of said elongate slat.

In Example 7, the subject matter of any one of Examples 1 to 6 may optionally include a plurality of elongate reinforcing members, each of the elongate slats including at least one elongate reinforcing member extending within said elongate slat in a manner so as to be aligned longitudinally to said elongate slat.

In Example 8, the subject matter of Example 7 may optionally include that the at least one elongate reinforcing member of at least one elongate slat may extend across an entire length of said elongate slat.

In Example 9, the subject matter of Example 8 may optionally include that the at least one eyelet-structure of each longitudinal end portion of the at least one elongate slat may be integral with the at least one reinforcing member extending within the at least one elongate slat.

In Example 10, the subject matter of Example 7 may optionally include that the at least one elongate slat may include a first elongate reinforcing member and a second elongate reinforcing member, wherein the first elongate reinforcing member may extend longitudinally inwards from the first longitudinal end portion of the at least one elongate slat for more than a tenth, or a fifth, or a quarter of a length of the at least one elongate slat and the second elongate reinforcing member may extend longitudinally inwards from the second longitudinal end portion of the at least one elongate slat for more than a tenth, or a fifth, or a quarter of a length of the at least one elongate slat.

In Example 11, the subject matter of Example 10 may optionally include that the at least one eyelet-structure of the first longitudinal end portion of the at least one elongate slat may be integral with the first elongate reinforcing member, and the at least one eyelet-structure of the second longitudinal end portion of the at least one elongate slat may be integral with the second elongate reinforcing member.

In Example 12, the subject matter of any one of Examples 1 to 11 may optionally include a retaining arrangement configured to align a bottom rail of the shutter curtain to a predetermined position on a ground and to retain or restrain the bottom rail from sideways or lateral movements in said position when the shutter curtain is lowered.

In Example 13, the subject matter of Example 12 may optionally include that the retaining arrangement may include two bollards fixed to the ground and two corresponding caps attached to the bottom rail of the shutter curtain.

In Example 14, the subject matter of Example 12 may optionally include that the retaining arrangement may include two brackets, each bracket having a Y-shaped slot, fixed to the ground and two corresponding insert members attached to the bottom rail of the shutter curtain.

In Example 15, the subject matter of any one of Examples 12 to 14 may optionally include a sliding guide arrangement which may include a first guiding rod and a second guiding rod fixed to the ground in an upright orientation and spaced apart in a manner so as to be respectively disposed adjacent the first and second side borders, respectively, of the shutter curtain when the shutter curtain is lowered, and a first sliding element and a second sliding element attached to a first longitudinal end and a second longitudinal end, respectively, of the bottom rail of the shutter curtain, wherein the first sliding element is in engagement with the first guiding rod and the second sliding element is in engagement with the second guiding rod.

In Example 16, the subject matter of any one of Examples 1 to 15 may optionally include that each eyelet-structure may include or may be a double-eyelets-structure such that the first row of eyelet-structures may form a first row of double-eyelets-structures and the second row of eyelet-structures may form a second row of double-eyelets-structures, wherein the roller shutter may further include a third cord and a fourth cord, and wherein the first cord may be strung loosely through all inner eyeholes of the double-eyelets-structures of the first row of double-eyelets-structures, the second cord may be strung loosely through all inner eyeholes of the double-eyelets-structures of the second row of eyelet-structures, the third cord may be strung loosely through all outer eyeholes of the double-eyelets-structures of the first row of double-eyelets-structures, and the fourth cord may be strung loosely through all outer eyeholes of the double-eyelets-structures of the second row of double-eyelets-structures.

Various embodiments have provided a roller shutter that may be effective in mitigating a sudden impact force, whereby risk of broken or fractured slats being dislodged from the shutter curtain be minimized or eliminated. Accordingly, the roller shutter of the various embodiments may be used in area where there is high explosion or blast risk.

While the invention has been particularly shown and described with reference to specific embodiments, it should be understood by those skilled in the art that various changes, modification, variation in form and detail may be made therein without departing from the scope of the invention as defined by the appended claims. The scope of the invention is thus indicated by the appended claims and all changes which come within the meaning and range of equivalency of the claims are therefore intended to be embraced.

The invention claimed is:

1. A roller shutter comprising a rotatable drum having a rotational axis;

a shutter curtain comprising a series of three or more elongate slats pivotally interlocked in a longitudinal-edge-to-longitudinal-edge arrangement one after another and arranged parallel to the rotational axis of the rotatable drum in a manner so as to be capable of being wound on and off the rotatable drum together in an interlocked state, each of the elongate slats having a first longitudinal end portion and a second longitudinal end portion, wherein the first and second longitudinal end portions being respectively aligned to form a first side border and a second side border, respectively, of the shutter curtain, and wherein the first longitudinal end portion and the second longitudinal end portion of each elongate slat are respectively provided with at least one eyelet-structure which protrudes therefrom, each eyelet-structure comprising a ring structure, whereby a first row of eyelet-structures and a second row of eyelet-structures are formed along the first and second side borders, respectively, of the shutter curtain; and at least a first cord and a second cord, the first cord being strung loosely through all eyelet-structures of the first row of eyelet-structures and the second cord being strung loosely through all eyelet-structures of the second row of eyelet-structures, and each cord being configured to confine all eyelet-structures of each respective row of eyelet-structures within a length of each cord, wherein each eyelet-structure substantially surrounds each respective cord, wherein each of the elongate slats comprises at least one elongate reinforcing member extending within said elongate slat in a manner so as to be aligned longitudinally to said elongate slat, wherein the at least one elongate reinforcing member extends across an entire length of said elongate slat, and wherein the at least one eyelet-structure of the first longitudinal end portion of each elongate slat is integrally connected to a first longitudinal end of the at least one reinforcing member and the at least one eyelet-structure of the second longitudinal end portion of each elongate slat is integrally connected to a second longitudinal end of the at least one reinforcing member in a manner so as to function cooperatively with the first cord and the second cord strung through the at least one eyelet-structure of each first longitudinal end portion and the at least one eyelet-structure of each second longitudinal end portion respectively to mitigate a sudden impact force on the roller shutter.

2. The roller shutter as claimed in claim 1, wherein each cord comprises a first cord end fixedly coupled to the rotatable drum and a second cord end having a stopper element which is configured to prevent the second cord end of said cord from sliding out of the respective row of eyelet-structures.

3. The roller shutter as claimed in claim 2, wherein each respective stopper element comprises a crimp end, a cord end cap, a knotted end, a bulged end, or an expanded end.

4. The roller shutter as claimed in claim 1, wherein the at least one eyelet-structure of each longitudinal end portion of each elongate slat is protruding in a longitudinal direction of said elongate slat, and wherein the at least one eyelet-structure is oriented with a hole-axis of a hole of the at least one eyelet-structure of each longitudinal end portion of each elongate slat in a direction parallel to a breadth of said elongate slat.

5. The roller shutter as claimed in claim 1, wherein each of the elongate slats comprises two eyelet-structures protruding from each longitudinal end portion of said elongate slat.

6. The roller shutter as claimed in claim 5, wherein each of the elongate slats comprises two elongate reinforcing members, each elongate reinforcing members extending across the entire length of said elongate slat.

7. The roller shutter as claimed in claim 6, wherein each of the elongate slats comprises a first longitudinal end cover fixedly coupled to the first longitudinal end portion and a second longitudinal end cover fixedly coupled to the second longitudinal end portion.

8. The roller shutter as claimed in claim 7, wherein each of the first longitudinal end cover and the second longitudinal end cover comprises two holes through which the two reinforcing members are respectively inserted so as to be extending across the entire length of said elongate slat.

9. The roller shutter as claimed in claim 1, further comprising a retaining arrangement configured to align a bottom rail of the shutter curtain to a predetermined position on a ground and to restrain the bottom rail from sideways or lateral movements in said position when the shutter curtain is lowered.

10. The roller shutter as claimed in claim 9, wherein the retaining arrangement comprises two bollards fixed to the ground and two corresponding caps attached to the bottom rail of the shutter curtain.

11. The roller shutter as claimed in claim 10, wherein each of the two bollards has a height higher than a height of the bottom rail of the shutter curtain.

12. The roller shutter as claimed in claim 9, wherein the retaining arrangement comprises two brackets, each bracket having a Y-shaped slot, fixed to the ground and two corresponding insert members attached to the bottom rail of the shutter curtain.

13. The roller shutter as claimed in claim 12, further comprising a sliding guide arrangement which comprises a first guiding rod and a second guiding rod fixed to the ground in an upright orientation and spaced apart in a manner so as to be respectively disposed adjacent the first and second side borders, respectively, of the shutter curtain when the shutter curtain is lowered, and a first sliding element and a second sliding element attached to a first longitudinal end and a second longitudinal end, respectively, of the bottom rail of the shutter curtain, wherein the first sliding element is in engagement with the first guiding rod and the second sliding element is in engagement with the second guiding rod.

14. The roller shutter as claimed in claim 12, wherein the two corresponding insert members are configured to be fitted into the Y-shaped slots of the two brackets respectively when the shutter curtain is lowered.

15. The roller shutter as claimed in claim 9, wherein each of the first cord and the second cord extends from the rotatable drum to the bottom rail of the shutter curtain in a manner so as to confine the series of three or more elongate slats within the length of each cord.

16. The roller shutter as claimed in claim 1, wherein each eyelet-structure comprises a double-eyelets-structure such that the first row of eyelet-structures forms a first row of double-eyelets-structures and the second row of eyelet-structures forms a second row of double-eyelets-structures, the double-eyelets-structure comprising a double-ring structure, wherein the roller shutter further comprises a third cord and a fourth cord, and wherein the first cord is strung loosely through all inner eyeholes of the double-eyelets-structures of the first row of double-eyelets-structures, the second cord is strung loosely through all inner eyeholes of the double-eyelets-structures of the second row of eyelet-structures, the third cord is strung loosely through all outer eyeholes of the double-eyelets-structures of the first row of double-eyelets-structures, and the fourth cord is strung loosely through all outer eyeholes of the double-eyelets-structures of the second row of double-eyelets-structures.

17. The roller shutter as claimed in claim 1, wherein each of the elongate slats comprises a first longitudinal end cover fixedly coupled to the first longitudinal end portion and a second longitudinal end cover fixedly coupled to the second longitudinal end portion.

18. The roller shutter as claimed in claim 17, wherein each of the first longitudinal end cover and the second longitudinal end cover comprises at least one hole through which the at least one elongate reinforcing member is inserted so as to be extending across the entire length of said elongate slat.

* * * * *